US009919861B2

(12) United States Patent
Bolognia et al.

(10) Patent No.: US 9,919,861 B2
(45) Date of Patent: Mar. 20, 2018

(54) SMART DISPENSING PACKAGING SYSTEM

(71) Applicant: WestRock MWV, LLC, Norcross, GA (US)

(72) Inventors: David B. Bolognia, Lanesboro, MA (US); Steven P. Jones, Elon, NC (US); Rodney D. Dixon, Burlington, NC (US)

(73) Assignee: WestRock MWV, LLC, Norcross, GA (US)

( * ) Notice: Subject to any disclaimer, the term of this patent is extended or adjusted under 35 U.S.C. 154(b) by 65 days.

(21) Appl. No.: 14/910,013

(22) PCT Filed: Aug. 5, 2014

(86) PCT No.: PCT/US2014/049722

§ 371 (c)(1),
(2) Date: Feb. 4, 2016

(87) PCT Pub. No.: WO2015/021014

PCT Pub. Date: Feb. 12, 2015

(65) Prior Publication Data

US 2016/0176617 A1 Jun. 23, 2016

Related U.S. Application Data

(60) Provisional application No. 61/862,583, filed on Aug. 6, 2013.

(51) Int. Cl.
*A61J 7/04* (2006.01)
*B65D 83/04* (2006.01)
(Continued)

(52) U.S. Cl.
CPC ..... *B65D 83/0463* (2013.01); *A61J 1/035* (2013.01); *A61J 7/0418* (2015.05); *A61J 7/0436* (2015.05);
(Continued)

(58) Field of Classification Search
CPC .. B65D 2211/00; B65D 5/38; B65D 83/0463; A61J 7/0436; A61J 7/0418; A61J 2200/30
(Continued)

(56) References Cited

U.S. PATENT DOCUMENTS 6,047,829 A 4/2000 Johnstone et al.
7,170,823 B2 * 1/2007 Fabricius ..... A61J 1/035 206/534.1
(Continued)

FOREIGN PATENT DOCUMENTS

BE 1010796 A3 * 2/1999 ..... A61J 7/0436
EP 1495746 5/2007
(Continued)

OTHER PUBLICATIONS

International Preliminary Report on Patentablity for PCT/US2014/049722.
(Continued)

*Primary Examiner* — Anthony Stashick
*Assistant Examiner* — Mollie Impink
(74) *Attorney, Agent, or Firm* — WestRock Intellectual Property Group

(57) ABSTRACT

A housing module (601) for use with a smart package (110) has a main body suitable for having an electronic device (605) affixed thereto. The main body includes one or more retention wings (603*a*, 603*b*) extending from the main body. The one or more retention wings are sized and configured for co-operation with a slot (88*a*, 88*b*) associated with the smart package (110) such that the housing module (601) is retainable substantially within the smart package (110). The one or more retention wings (603*a*, 603*a*) are shaped, sized and configured to co-operate with an end-stop of the slot (88*a*, 88*b*) for locating the housing module (601) within the smart package (110).

3 Claims, 14 Drawing Sheets

(51) Int. Cl.
*B65D 5/38* (2006.01)
*A61J 1/03* (2006.01)

(52) U.S. Cl.
CPC ..... *B65D 5/38* (2013.01); *A61J 2200/30* (2013.01); *B65D 2215/02* (2013.01)

(58) Field of Classification Search
USPC ..... 206/534.1, 534.2, 828; 700/242, 244
See application file for complete search history.

(56) References Cited

U.S. PATENT DOCUMENTS

| | | | | |
|---|---|---|---|---|
| 7,845,496 | B2 * | 12/2010 | Hession | B65D 5/38 206/528 |
| 2004/0050746 | A1 * | 3/2004 | Dunlop | A61J 7/0481 206/534 |
| 2004/0108322 | A1 * | 6/2004 | Maietta | A61J 7/0481 221/2 |
| 2010/0236973 | A1 * | 9/2010 | Ahag | A61J 7/0481 206/531 |
| 2015/0249059 | A1 * | 9/2015 | Maijala | A61J 1/035 257/664 |

FOREIGN PATENT DOCUMENTS

| | | |
|---|---|---|
| FR | 2960859 | 12/2011 |
| WO | 2009/132191 | 10/2009 |
| WO | 2011/054104 | 5/2011 |

OTHER PUBLICATIONS

International Search Report and Written Opinion for PCT/US2014/049722, dated Jan. 15, 2015.

* cited by examiner

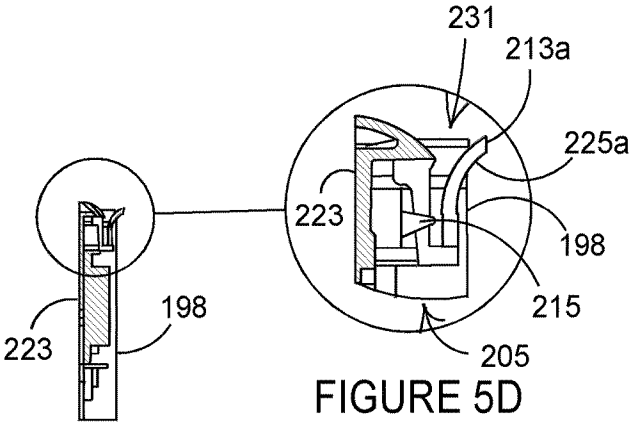
FIGURE 5D
FIGURE 5C
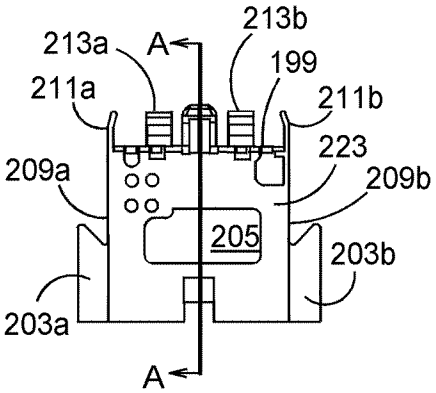
FIGURE 5B
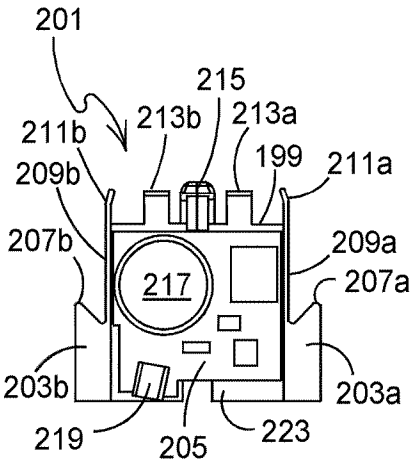
FIGURE 5A
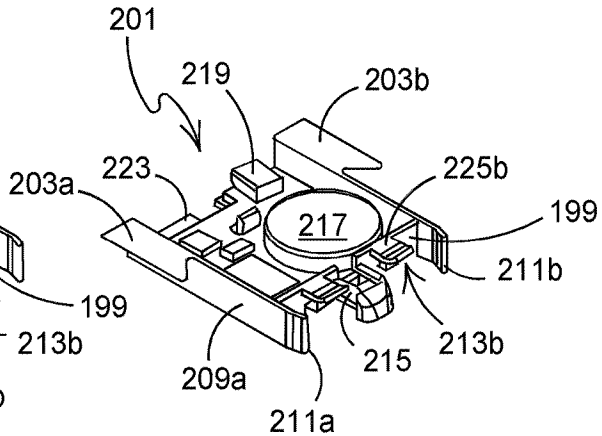
FIGURE 5G
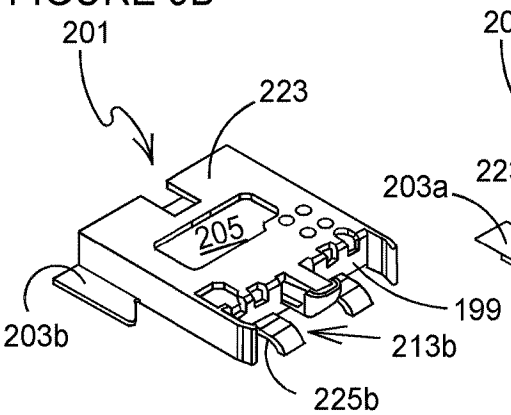
FIGURE 5F
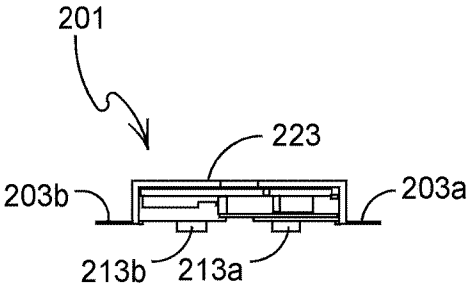
FIGURE 5E 395
329
339

361
363
339
341
P
B
335
345

363
369
395
371
375a
361
339
341
345
343

363
369
395
375a
339
345
343
359

393a
T
B
F
P 393b
393a

331
G
G
G
G
341
351
339
393b
343
G
345
393a
G
337
357
335

P
B
12
20
16
68
329
395
section AA
66
215
375a
369/371
76
38
205
201
34
36

68
395
66
211b
369/371
375a
199
213a
76

66
215
213a
375a
369/371
76

12
20
16
68
329
section BB
66
369/371
395
211b
375a
213a
199
76
225a
223
205
38

SMART DISPENSING PACKAGING SYSTEM

CROSS REFERENCE TO RELATED APPLICATION

This application is a National Stage entry into the United States of PCI/US2014/49722, filed on Aug. 5, 2014, and also claims the benefit of U.S. Provisional Patent Application No. 61/862,583 filed Aug. 6, 2013, both of which are incorporated herein by reference in their respective entireties.

FIELD OF THE INVENTION

The present invention relates generally to smart packages for dispensing articles and to lockable packages such as child-resistant, senior-friendly packages for healthcare type applications. More specifically, but not exclusively, the invention relates to sleeve-and-drawer style packages having an internal slidable lockable receptacle, that is releasably lockable within an outer sleeve; and to an auxiliary device for use in collecting data relating to the dispensing of articles held by the internal lockable receptacle.

Aspects of the invention relate to a package, to an outer sleeve, to a lockable receptacle, to housing modules, to an outer sleeve blank and to a lockable receptacle blank.

BACKGROUND OF THE INVENTION

In the field of smart packaging for dispensing articles, specifically, but not exclusively to the field of smart packaging for use in healthcare applications, it is known to provide packaging systems, wherein electronic modules are provided. Data relating to the use of the package and the dispensing of medication is collected and analysed by the electronics module in order to track and monitor the administration of medication by patients. It is also known to provide packaging systems that are configured to issue reminder signals to patients and that are configured to provide an indication of a patient's compliance with their treatment plan. Such smart packaging has many benefits which may include: improving the effectiveness of medical treatment; mitigating against incorrect dosages being taken; and/or reducing the labour expended by medical professionals that might otherwise be involved in tracking and monitoring a patient's treatment.

EP1,495,746 B1 discloses some known smart packages comprising a dispenser, a blister card and means for detecting or determining when access has been gained to the blister card within the package. One dispenser disclosed has a curved body to facilitate a friction fit of a blister card therein; an open end; and a slot provided to enable a user's finger to contact and easily slide the blister card out of the open end of the dispenser. It is disclosed that the means for detecting or determining when access has been gained to the blister card comprises a detector, based upon optical, magnetic or mechanical principles, that is able to detect a feature of the blister card when the blister card mates with the detector. The detector is coupled to electronics for storing data and for issuing reminder signals to a patient in order to track and improve patient compliance.

Whereas it may improve patient compliance with a course of medication if the patient is able to readily gain access to the blister card containing their medication, it is extremely undesirable for a non-authorised user of the package, for example a child to be able to readily gain access to pharmaceutical products.

There is therefore a requirement for a smart packaging system that is sufficiently child-resistant whilst at the same time being sufficiently senior friendly so as to avoid discouraging a patient from accessing their medication. Further considerations for this type of packaging are the need for the packaging to be able to withstand repeated use, be more economical to produce and preferably be made of recyclable and/or sustainable materials.

Child resistant, senior friendly sleeve and drawer style packages are known, for example from U.S. Pat. No. 6,047,829, wherein a two-piece paperboard package is disclosed that houses a unit dose product on an internal slide card within an outer paperboard shell. The package has an internal lock that prevents the slide card from being pulled out without first triggering a lock release mechanism. The package is thereby child resistant and senior friendly.

The present disclosure provides improvements in the field of smart packaging by providing a generally paperboard, sleeve and drawer style child resistant, senior friendly smart packaging system comprising means for detecting or determining when the contents thereof have been accessed and/or for providing other data collation, use tracking and/or reminder signalling to improve patient compliance.

Whereas the invention finds particular beneficial application in the field of healthcare packaging where sleeve-and-drawer packages contain unit dose packages for pharmaceutical tablets, the invention of the present disclosure is not limited to that application and advantageous features components and combinations thereof disclosed herein may be employed in other packaging and dispensing applications. For example, packaging systems of the present disclosure may be utilised in automated inventory and other product tracking applications where the dispensing and/or use of products, such as, but not limited to: small tools, medical devices, small high-value items such as consumer electronics and other consumable items, is beneficially monitored and tracked.

SUMMARY OF INVENTION

According to a first aspect of the present invention for which protection is sought, there is provided a housing module for use with a smart package, the housing module having a main body suitable for having an electronic device affixed thereto, the main body comprising one or more retention wings extending from the main body, the one or more retention wings each being sized and configured for co-operation with a slot comprised within the smart package such that the housing module is retainable substantially within the smart package. The one or more retention wings are shaped, sized and configured to co-operate with an end-stop of the slot for locating the housing module within the smart package. Beneficially, therefore the housing module is affixable within the smart package without the need for adhesive or other auxiliary affixing mechanisms (screws, fasteners and the like). This permits the housing module to be easily re-used if required.

Optionally, the main body has first and second side walls connected together by a top wall and comprises two retention wings, each retention wing being substantially planar in form and extending from a lower edge of the first and second side walls respectively. The side walls provide additional protection for the electronics device when affixed thereto and also provide a further means for interlocking the housing module to a smart package.

Optionally, the two retention wings are each shaped, sized and configured to co-operate with an end-stop of the slot within the smart package by having a recessed or hook-shaped portion.

Optionally, each of the two retention wings has a length that is less than the length of the first or second side wall from which the retention wing extends.

Optionally, the housing module further comprises a front wall and one or more lifting teeth having a ramped upper surface for guiding a registration mechanism of the smart package toward a registration slot, each lifting tooth having a first end adjoined to the front wall and second tip end spaced from the front wall and wherein the second tip end of each lifting tooth sits in a plane that is below a plane in which a bottom edge of the front wall lies.

Optionally, a housing module further comprises a front wall and one or more lifting teeth having a ramped upper surface for guiding a registration mechanism of the smart package toward a registration slot, each lifting tooth having a chamfered portion or bevelled corner portion such that the top surface of the one or more lifting teeth is ramped in at least two directions.

According to a second aspect of the disclosure for which protection is sought, there is provided a housing module for use with a smart package, the housing module having a main body suitable for having an electronic device affixed thereto, the main body comprising a front wall and one or more lifting teeth having a ramped upper surface for guiding a registration mechanism of the smart package toward a registration slot, each lifting tooth having a first end adjoined to the front wall and second tip end spaced from the front wall, and wherein the second tip end of each lifting tooth extends to and rests in a plane that is below a plane in which a bottom edge of the front wall rests. Beneficially, the one or more lifting teeth are thereby able to create a snap-fit with an appropriately configured smart package and at the same time ensure that a registration mechanism is fully guided into the registration slot.

According to a third aspect of the disclosure for which protection is sought, there is provided a housing module for use with a smart package, the housing module having a main body suitable for having an electronic device affixed thereto, the main body comprising a front wall and one or more lifting teeth having a ramped upper surface for guiding a registration mechanism of the smart package toward a registration slot, each lifting tooth having a chamfered or bevelled corner portion such that the top surface of the one or more lifting teeth is ramped in at least two directions.

Optionally, the main body comprises first and second side walls connected together by a top wall and wherein the chamfered or bevelled corner portion is formed on a side of the lifting tooth that is furthest from a side wall of the main body or wherein the chamfered or bevelled corner portion is formed on a side of the lifting tooth that is closest to a side wall of the main body.

According to fourth aspect of the disclosure for which protection is sought, there is provided a housing module for use with a smart package, the housing module having a main body suitable for having an electronic device affixed thereto, the main body comprising a front wall and further comprising one or more stopping ribs extending from the main body to an extent that is beyond the plane of the front wall for providing a stop to limit inward travel of a lockable receptacle of the smart package, which stop is spaced from the front wall.

Optionally, the main body comprises first and second side walls connected together by a top wall, wherein two stopping ribs are provided and are each formed as contiguous extensions of the first and second side walls respectively.

Optionally, the two stopping ribs are angled or curved inwardly toward one another at an end region of the stopping ribs.

Optionally, the main body is a unitary moulded structure and is formed from plastics material.

According to a fourth aspect of the disclosure for which protection is sought, there is provided a housing module defined in the relevant preceding paragraphs and having an electronic device affixed to the main body.

According to a fifth aspect of the disclosure for which protection is sought, there is provided an outer sleeve for use with a smart package, the outer sleeve is formed from a blank of foldable sheet material having a substantially tubular structure, comprising a top wall, first and second side walls and a bottom wall defining a cavity therein for a lockable receptacle of the smart package and wherein the outer sleeve additionally comprises an internal compartment, formed as a unitary assembly within the tubular structure, comprising a compartment first side panel, a compartment bottom panel, and a compartment second side panel, hinged one to the next in series and wherein a first slot is provided between the compartment first side panel and the compartment bottom panel.

Optionally, the outer sleeve is formed from a blank of foldable sheet material and the internal compartment is formed as a unitary assembly within the tubular structure.

Optionally, a second slot is provided between the compartment second side panel and the compartment bottom panel.

Optionally, the first slot or second slot terminates in an end-stop sized and arranged to facilitate the accurate location of a housing module and an electronic device affixed thereto, within the internal compartment.

Optionally, the compartment first side panel and compartment second side panel each have a shaped, rear, lower edge to facilitate insertion of an electronic device housing module into the internal compartment.

Optionally, the shaped rear lower edges of the compartment first and second side panels are chamfered or angled.

Optionally, the outer sleeve comprises a first part of a two-part locking mechanism for locking the lockable receptacle within part of the cavity of the outer sleeve, and the outer sleeve comprises a release mechanism for enabling the two-part locking mechanism to be unlocked such that the lockable receptacle can be at least partially withdrawn from the outer sleeve.

Optionally, an outer sleeve may additionally comprise a housing module disposed within the internal compartment.

Optionally, the housing module comprises a main body portion having first and second side walls connected together by a top wall and comprises two retention wings, each retention wing being substantially planar in form and extending from a lower edge of the first or second side walls respectively, wherein a first retention wing is sized and configured for insertion into the first slot of the internal compartment, wherein a second retention wing is sized and configured for insertion into the second slot of the internal compartment such that the housing module is retainable by virtue of a friction fit between the first and second retention wings and the first and second slots and wherein the first and second retention wings are shaped, sized and configured to co-operate with the end-stops of the first and second slots respectively for locating the housing module at a correct longitudinal location relative to a longitudinal axis of the outer sleeve.

According to a sixth aspect of the disclosure for which protection is sought, there is provided an outer sleeve for use with a smart package, the outer sleeve having a substantially tubular structure, comprising a top wall, first and second side walls and a bottom wall defining a cavity therein for a lockable receptacle of the smart package and wherein the outer sleeve additionally comprises an internal compartment for accommodating an electronic device having a data port therein, the outer sleeve further comprising a composite rear end wall for closing a rear end of the substantially tubular structure close to the internal compartment, the rear end wall comprising a rear access structure for enabling access to the data port, wherein the rear access structure comprises a frangible connected hingable tab formed in an innermost rear end closure panel and aperture formed in part in an outermost rear end closure panel and in part in an rear closure end flap that is affixable to the bottom wall of the outer sleeve.

Optionally, the outer sleeve is formed from a blank of foldable sheet material and the internal compartment is formed as a unitary assembly within the tubular structure.

Optionally, the outer sleeve defined in the relevant preceding paragraphs is formed from paperboard.

According to a seventh aspect of the disclosure for which protection is sought, there is provided a blank comprising a series of hingedly connected panels including: an outer top panel, a first side panel, a bottom panel, a second side panel and an inner top panel for forming a substantially tubular structure defining a cavity therein for a lockable receptacle; and the blank comprising a series of compartment panels including: a compartment first side panel, a compartment bottom panel, a compartment second side panel and a compartment glue flap, wherein a first slot is provided between the compartment first side panel and the compartment bottom panel and wherein a second slot is provided between the compartment second side panel and the compartment bottom panel.

Optionally, the compartment second side panel is hinged to the inner top panel.

Optionally, the blank is foldable and affixable into a flat-form outer sleeve, wherein the compartment bottom panel is affixed to an inside surface of the bottom panel; the compartment glue flap is affixed to the inner top panel; and the outer top panel is affixed to inner top panel, the flat-form outer sleeve being stowable in a substantially flat-form and being openable into a tubular form whereupon the internal compartment is automatically set-up.

According to an eighth aspect of the disclosure for which protection is sought, there is provided a lockable receptacle for use in a smart package, the lockable receptacle comprising a registration mechanism for use with a detector of the smart package for registering insertion of the lockable receptacle within the smart package and/or for registering withdrawal of the lockable receptacle out of the smart package, the lockable receptacle further comprising a raising arrangement for lifting at least a leading part of the registration mechanism to aid with the accurate location of the registration mechanism relative to the detector.

Optionally, the registration mechanism is planar tab formed from one or more affixed plies of material, wherein the lockable receptacle comprises a folded flap proximate to the planar tab and wherein the folded flap is coupled to a main body of the lockable receptacle by a hinge connection, the raising arrangement being formed along or proximate to the hinge connection and comprising one or more or a combination of: a leaf shaped panel, a leaf-shaped panel and similar shaped aperture, a square foot, a pair of square feet, a round foot and a pair of rounded feet.

Optionally, the folded flap is a locking tail flap and provides a second part of a two-part locking mechanism for use with an outer sleeve of the smart package.

Optionally, a lockable receptacle is formed from paperboard and comprises one or more products held in individual blisters.

According to a ninth aspect of the disclosure for which protection is sought, there is provided a blank, the blank comprises: a first top panel, a first bottom panel, a first locking tail flap panel, a second locking tail flap panel, a first tab panel extending contiguously from the first top panel and a second tab panel extending contiguously from the first bottom panel, the first locking tail flap panel being hinged to the first top panel, the second locking tail flap panel being hinged to the first bottom panel, the first top panel being hinged to the first bottom panel, wherein the blank additionally comprises a raising arrangement the raising arrangement being formed along or proximate to the hinge connections between the first and second locking tail flap panels and the first top and bottom panels respectively and wherein the raising arrangement comprises one or more or a combination of: a leaf shaped panel, a leaf-shaped panel and similar shaped aperture, a square foot, a pair of square feet, a round foot and a pair of rounded feet.

According to a tenth aspect of the disclosure for which protection is sought, there is provided a smart package comprising: an outer sleeve, a lockable receptacle, an electronic device for detecting or determining when access has been gained to the lockable receptacle, and a housing module to which the electronic device is affixed, the outer sleeve providing a cavity for the lockable receptacle and having a rear end and an open or openable front end through which the lockable receptacle is insertable and through which the lockable receptacle is withdrawable, the package comprising a two-part locking mechanism for locking the lockable receptacle within the cavity of the outer sleeve, and the package comprising a release mechanism for enabling the two-part locking mechanism to be unlocked such that the lockable receptacle can be at least partially withdrawn from the outer sleeve, the outer sleeve comprising an internal compartment for receiving and retaining the housing module and electronic device.

Within the scope of this application it is envisaged that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Exemplary embodiments of the invention will now be described with reference to the accompanying drawings, in which:

FIG. 5A is a plan view of a bottom side of a housing module and an electronic device affixed thereto according to an aspect of the disclosure;

FIG. 5B is a plan view of a top side of the housing module and electronic device of FIG. 5A;

FIG. 5C is a view taken along the line A-A in the direction of the arrows as indicated in FIG. 5B;

FIG. 5D is an enlarged view of part of the illustration of FIG. 5C;

FIG. 5E is a front end view of the housing module and electronic device of FIG. 5A;

FIG. 5F is an isometric view of the top, front and first side of the housing module and electronic device of FIG. 5A;

FIG. 5G is an isometric view of the bottom, front and second side of the housing module and electronic device of FIG. 5A;

DETAILED DESCRIPTION OF EXEMPLARY EMBODIMENTS OF THE PRESENT INVENTION

Detailed descriptions of specific embodiments of the packages, outer sleeves, lockable receptacles, electronic devices, housing modules, blanks and methods are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, outer sleeves, lockable receptacles, electronic devices, housing modules, blanks and methods described herein may be embodied in various and alternative forms. The figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Reference is now made to the accompanying Figures for the purpose of describing, in detail, preferred and exemplary embodiments of the present disclosure. The Figures and detailed description are provided to describe and illustrate examples in which the disclosed package and its parts may be made and used, and are not intended to limit the scope thereof. Those skilled in the art will readily appreciate that the disclosed packages can be used to store and dispense a variety of products in a manner that enables product tracking to take place. More specifically, the disclosed lockable receptacles can be used for the storage of products, such as for example, medication and other healthcare or pharmaceutical products, electrical items and any other product wherein the tracking for controlled healthcare, controlled inventory, improved security or other reasons is advantageous, without departing from the inventive aspects of the present disclosure. It is envisaged for example that cigarettes and other tobacco products and the like may be held by a lockable receptacle in a package of the disclosure to track the progress of a patient quitting smoking by monitoring their usage of the cigarettes and other tobacco products and/or to issue an alarming signal when access to the package is attempted too quickly within the patient's quitting program.

Figure 22B:
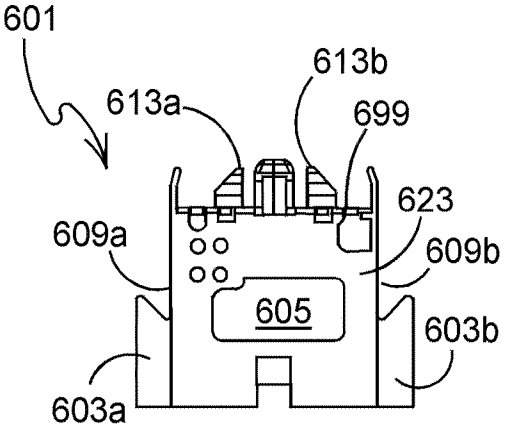
FIGS. 22A - 22D are views of a housing module according to another aspect of the disclosure having an electronic device affixed thereto.
Figure 22D:
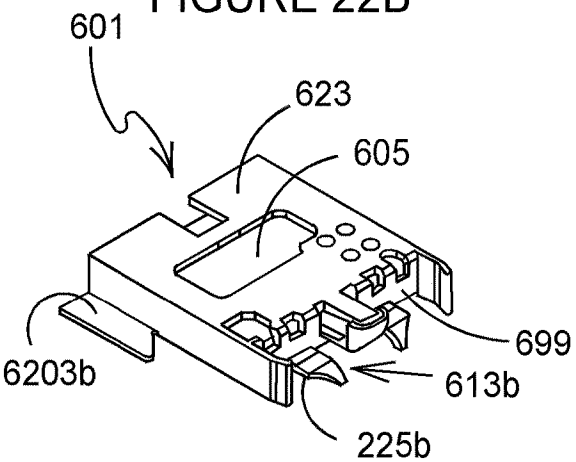
Figure 22A:
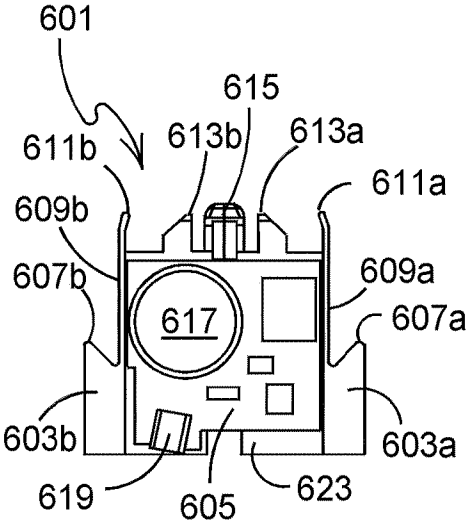
Figure 22C:
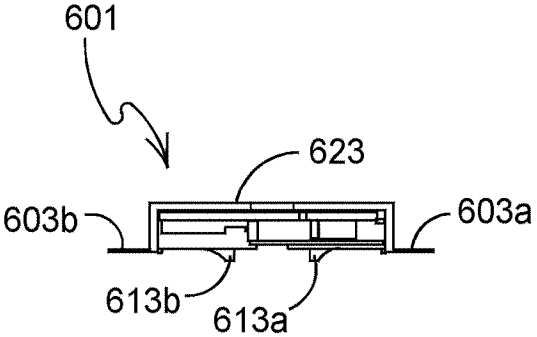

Generally the disclosure relates to a package (see FIGS. 16, 17, 18 and 19) that has improved child-resistant, senior friendly features and that is preferably (though nevertheless optionally) formed, as much as possible from paperboard in order to provide a smart package that is lower-cost, slimmer, more discrete, more recyclable and more environmentally considerate compared to known smart packages. Generally the smart packaging system of the disclosure comprises an outer sleeve 110 (see FIGS. 3, 4, 6, 7, 16, 17, 18 and 19) having a cavity for receiving a product holding lockable receptacle 329 (see FIGS. 12, 13, 14, 15, 15A-15C 16, 17, 18 and 19) and having a compartment 74 for receiving an electronic device 205, 605 and its housing module 201, 601 (see FIGS. 5A-5G, 6, 7, 16, 17, 18 and 19; and FIGS. 22A 22D). The electronic device 205, 605 may comprise: a printed circuit board (PCB), a power supply 217, 617, a data storage structure, a data port 219, 619, and a detector 215, 615 for registering movement of the lockable receptacle 329 into and out of the outer sleeve 110.

The lockable receptacle 329 provides a means for holding products 'P, which may optionally be disposed in discrete blisters 'B' or containers. Use of discrete blisters is beneficial for: aiding in the individual dispensing of products 'P'; for the protection of the products; for avoiding contamination; and/or to aid product freshness. The lockable receptacle 329 additionally provides a second part 64 of a two-part complementary locking mechanism so that the product bearing lockable receptacle 329 can be locked within the cavity of the outer sleeve 110 in such a manner that the products 'P' are not accessible without activation of a release mechanism 58. The lockable receptacle 329 also provides a registration mechanism 369/371 for interaction with the detector 215, 615 of the electronic device 205, 605. The housing module 201, 601 provides a protective housing for the electronic device 205, 605 and a means for interconnecting the electronic device 205, 605 to the outer sleeve 110. The housing module 201, 601 is additionally and beneficially configured and structured to provide an interface between the electronic device 205, 605 and the registration mechanism 369/371. The interface protects the electronic device 205, 605 and/or registration mechanism 369/371 against critical damage or wear that could otherwise result from repeated impact or over-impact of the registration mechanism 369/371 and the electronic device 205, 605. The interface also assists with the correct location of the registration mechanism 369/371 relative to the detector 215, 615 in order to ensure that withdrawal and reinsertion of the lockable receptacle 329 is accurately and repeatedly detected.

The outer sleeve 110 and lockable receptacle 329 are optionally each formed from a separate single blank 10, 331, 431, 531 formed from sheets of suitable substrate. Preferably, but nevertheless optionally, the blanks 10, 331, 431, 531 are formed from paperboard, optionally having at least one coated and printed side. Optionally in the illustrated embodiments, a polymer based tear resistant coating may be applied to at least on one side thereof, for example the blanks 10, 331, 431, 531 may be formed from Printkote® EasySeal Plus paperboard. It is to be understood that, as used herein, the term "suitable substrate" includes all manner of foldable sheet material such as paper, paperboard, fibreboard, corrugated board, cardboard, plastics material, coated material, uncoated material printed material, combinations thereof, and the like. It should be recognized that one or other numbers of blanks may be employed, where suitable.

Figure 1:
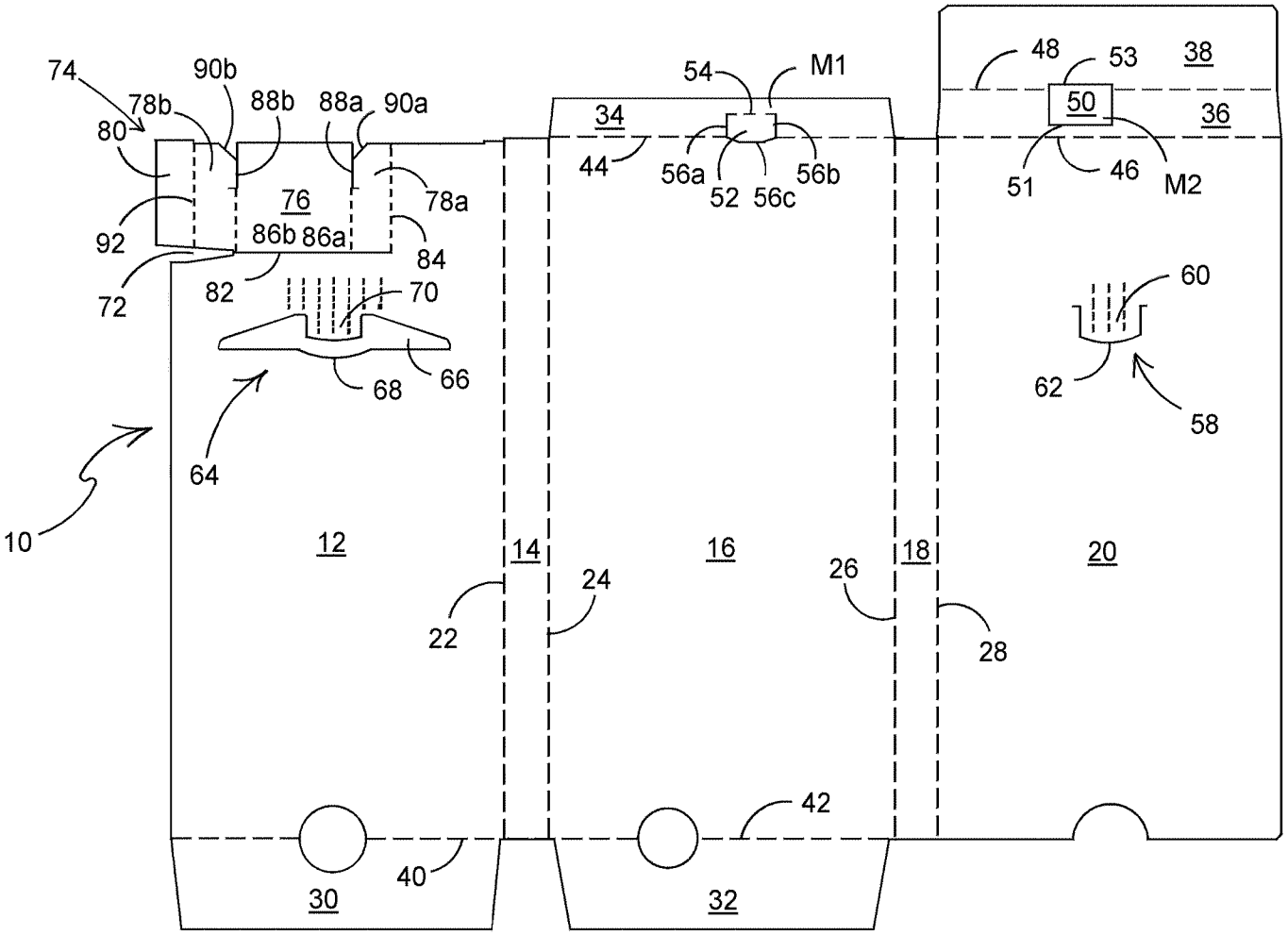
FIG. 1 is a plan view from above a blank for forming an outer sleeve having an electronic device receiving compartment according to an aspect of the invention.
Figure 2A:
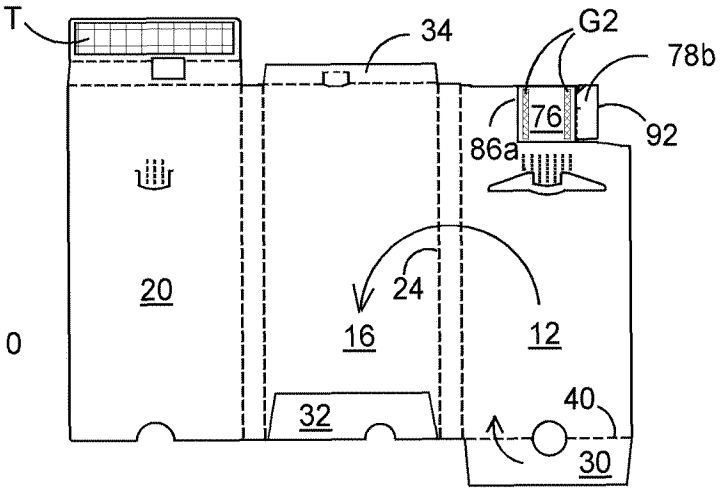
FIGS. 2 to 2C are plan views from above of steps showing the blank of FIG. 1 being folded and constructed into a flat-form assembly which is operable into an outer sleeve having an electronic device receiving compartment.
Figure 2:
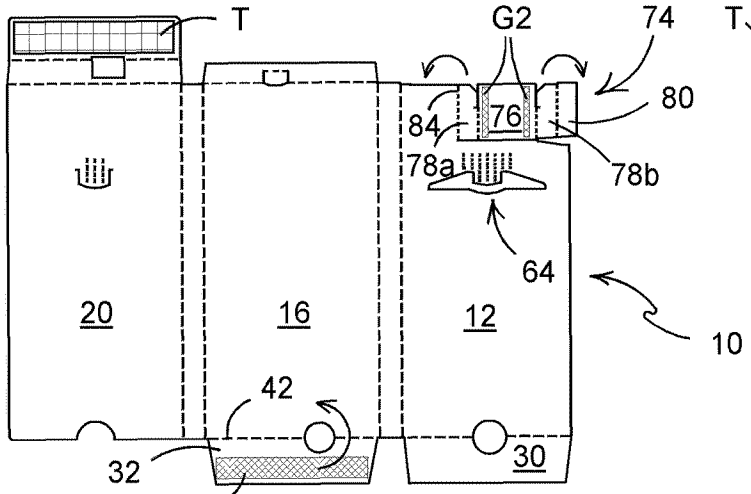
Figure 3:
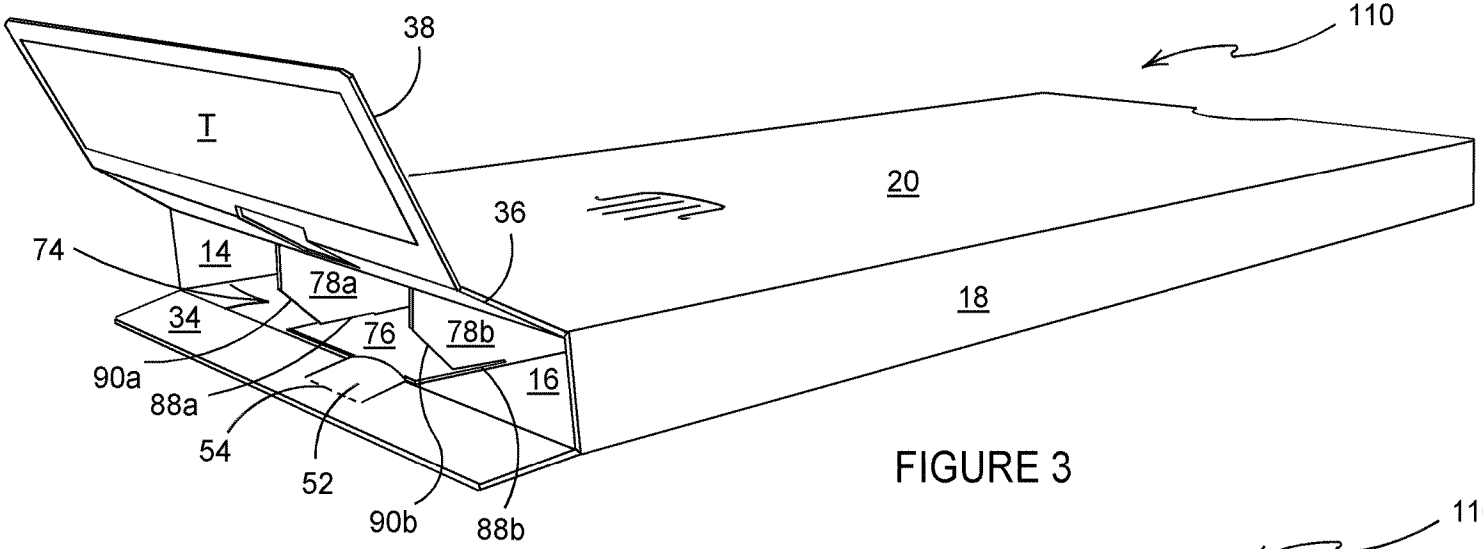
FIG. 3 is a perspective view from above of an outer sleeve constructed from the blank of FIG. 1, having an open rear-end and showing therethrough the electronic device receiving compartment.
Figure 4:
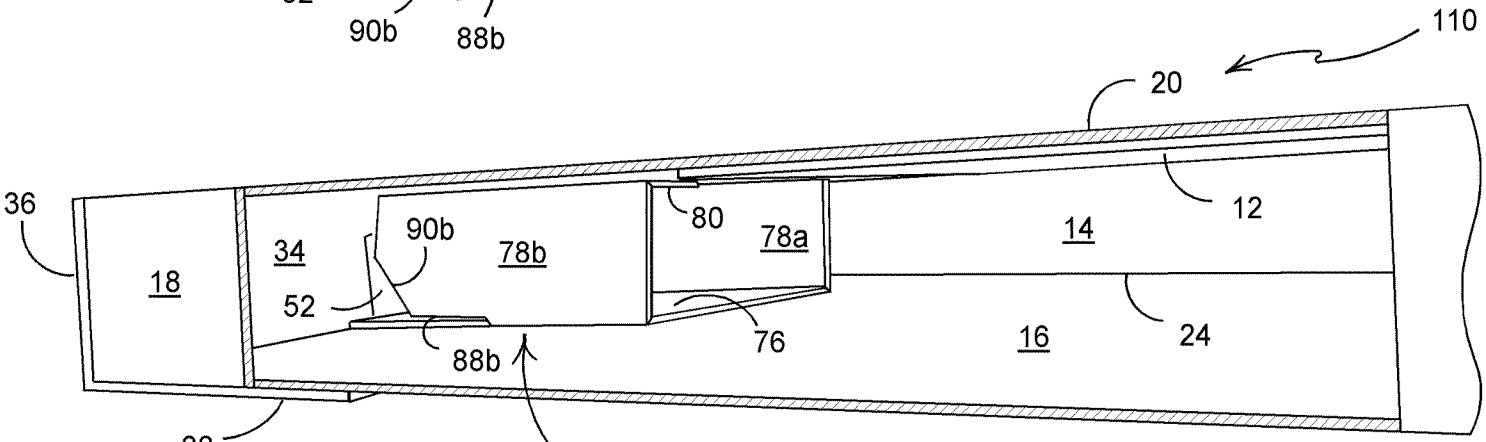
FIG. 4 is an internal perspective view through a cut-away side wall of the outer sleeve of FIG. 3, wherein the rear-end wall has been closed and the electronic device receiving compartment can be seen.

Referring now to a first illustrated embodiment of the packaging system in more detail, specific reference is made to FIGS. 1 and 2 wherein, there is illustrated the blank 10 for forming the outer sleeve 110 illustrated in FIGS. 3 and 4. The blank 10 comprises a series of main panels 12, 14, 16, 18, 20 for forming a generally tubular structure of the outer sleeve 110 which provides a cavity for a lockable receptacle 329 (such as the lockable receptacle shown in FIGS. 8 to 15C); panels 78*a*, 76, 78*b*, 80 for forming an auxiliary receiving compartment 74; elements 66, 68, 70 for forming a first part 64 of a two-part complementary locking mechanism; and elements 60, 62 for forming a release mechanism 58. The blank 10 also comprises panels 34, 36, 38 for forming a rear end wall; and panels 30, 32 for forming a stopping mechanism (and smooth finished and reinforced frontage) for the front end of the outer sleeve 110.

The series of main panels 12, 14, 16, 18, 20 comprises: an inner top panel 12, a first side panel 14, a bottom panel 16, a second side panel 18; and an outer top panel 20, hinged one to the next by means of longitudinally extending fold lines 22, 24, 26 and 28 respectively.

Figure 2C:
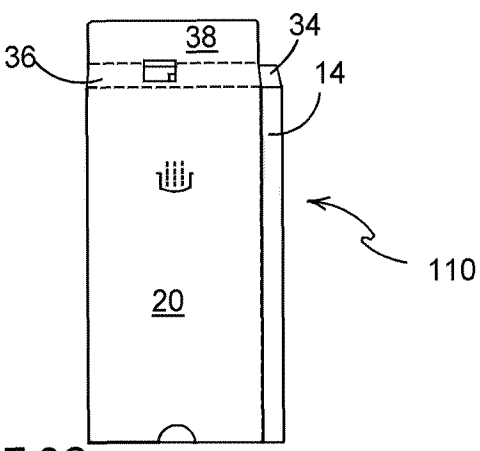

The auxiliary receiving compartment 74 (also referred to herein as "electronic device receiving compartment", "internal compartment" and "compartment") is formed from: a first compartment side panel 78*a*, a compartment bottom panel 76, a second compartment side panel 78*b* and a compartment glue flap 80. The panels 78*a*, 76, 78*b*, 80 for forming the internal compartment 74 are hinged one to the next in series along longitudinally extending fold lines 92, 86*b*, 86*a* and 84. The first compartment side panel 78*a*, compartment bottom panel 76, and second compartment side panel 78*b* are formed from material that otherwise would have formed part of the inner top panel 12. The first compartment side panel 78*a* and compartment bottom panel 76 are disconnected from the inner top panel 12 by means of a cut line 82. The second compartment side panel 78*b* and glue flap 80 are optionally separated from the inner top panel 12 by means of a recess 72. The recess 72 is optional and may be beneficial in facilitating the automated assembly of the blank 10 into a flat-form outer sleeve (see FIG. 2C) by an automated packaging assembly line. The panels 78*a*, 76, 78*b*, 80 for forming the internal compartment 74 are attached to the inner top panel 12 by means of a hinge connection 84 between the inner top panel 12 and the first compartment side panel 78*a*.

The first compartment side panel 78*a* and second compartment side panel 78*b* each comprise a shaped, optionally angled or chamfered, lower rear edge 90*a*, 90*b*. The shaped rear edge 90*a*, 90*b* of each of the first and second compartment side panels 78*a*, 78*b* terminates proximate to a cut or slit 88*a*, 88*b* formed in each of the first and second compartment side panels 78*a*, 78*b* respectively. In the erect auxiliary receiving compartment 74, the cuts or slits 88*a*, 88*b*, each form a slot which provides an interconnection for the electronic device housing module 201 and the shaped (chamfered) lower rear edges 90*a*, 90*b* provide a guide means to facilitate the proper insertion and location of the housing module 201 within the internal compartment 74. This is described in greater detail below.

The first part of the two-part locking mechanism 64 optionally includes a first aperture 66, defined by a shaped cut line and a first locking edge 68 formed in the inner top panel 12 (the first locking edge 68 being defined by the aperture 66).

The release mechanism, denoted generally by reference 58 comprises: an outer moveable tab 60 formed in the outer top panel 20; and an inner tab 70 formed in the inner top panel 12. Each moveable tab 60, 70 is preferably, but nevertheless optionally integrally formed within the blank 10. Each moveable tab 60, 70, comprises an anchored portion and a free edge which is defined by a cut or other frangible connection such that the free edge is separated (or separable) from the remainder of the outer top panel 20 and inner top panel 12 respectively. The moveable tabs 60, 70 are thereby moveable below the plane of the panel from which they are formed (the outer top panel 20 and inner top panel 12 respectively).

Optionally, the outer moveable tab 60 formed in the outer top panel 20 has a width that is similar to the width of the innermost moveable tab 70 in the inner top panel 12. The outer moveable tab 60 may be defined by a substantially "U"-shaped cut or frangible line 62 comprising of: two first and second side edges that are optionally substantially parallel to one another and which each terminate in an acutely radiussed arcuate cut-line termination to prevent their further propagation; and a front cut that spans between and terminates at the first and second side edges. The inner moveable tab 70 may be defined in part by the aperture 66 forming the locking edge 68. The aperture 66 may be considered as a recess into which a locking tail flap 395 of the lockable receptacle 329 may be inserted, in a locked configuration of the lockable receptacle 329 and outer sleeve 110. The roughly "U"-shaped moveable tab 60 is preferably, but nevertheless optionally, disposed in a substantially medial position within the outer top panel 20. The position of the shaped moveable tab 60 is dependent upon the shape, configuration and size of the first part of the two-part locking mechanism 64.

The blank 10 also comprises: a top rear end flap 36 that is hinged by a lateral fold line 46 to the "rear-end" of the outer top panel 20; and a bottom rear end flap 34 that is hinged by a lateral fold line 44 to the "rear-end" of the bottom panel 16. The top and bottom rear end closure panels 36, 34 in use are folded approximately 90° about fold lines 46 and 44 and are affixed or held in face contacting relationship to one another to form a composite rear end wall 34/36 for the outer sleeve 110 (see FIG. 4).

Figure 2B:
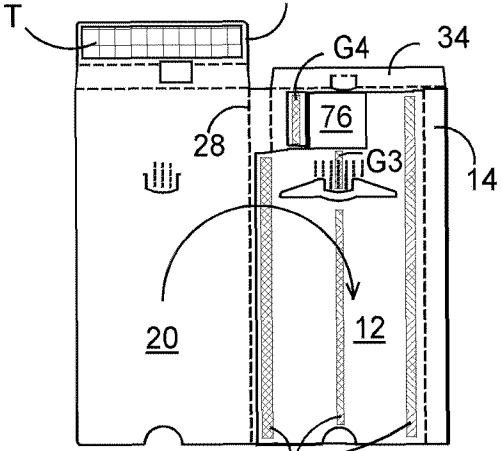

As referred to above, the outer sleeve 110 comprises a receiving compartment 74 for an electronic device 205 (see FIGS. 5A-5G) that may have a data and/or charging port 219, for example a standard Universal Serial Bus (USB) port or a non-standard USB-type port 219. In order to be able to gain access to such a data and/or charging port 219, whilst yet retaining a sufficient child-resistance quality, the outer sleeve 110 is provided with a bespoke rear access means 52/50. The provision of a rear-access means 52/50 for such a port 219 additionally may optionally require an affixing means to hold the rear-end wall 34/36 in its erect form. Such an affixing means may be in addition to or in the alternative to the use of an adhesive bond directly between the top and bottom rear end closure panels 36, 34. A rear closure end flap 38 is therefore optionally provided and is hinged by a lateral fold line 48 to the top rear end closure panel 36. The rear closure end flap 38 is provided for securely holding the composite rear end wall in its erected form. An adhesive tape 'T' (see FIGS. 2, 2A and 2B) additionally permits secure manual closure of the outer sleeve 110, optionally without the need for a hot melt adhesive. Secure manual closure may be beneficial because it allows the housing module 201 and electronic device 205 to be manually loaded into the outer sleeve 110 as required by a pharmacist or other medical professional and yet be securely affixed in a closed position by the strong adhesive tape 'T'.

The rear-access means 52/50, if provided may optionally comprise an openable port tab 52 and a port aperture 50 as shown in FIG. 1. The openable port tab 52 is defined by: a hinge connection 54, optionally frangible sides 56*a*, 56*b* and an optionally frangible top edge 56*c*. The frangible top edge 56*c* is formed in registry with the lateral fold line 44 between the bottom panel 16 and the bottom end closure panel 34. The hinge connection 54, about which the openable port tab 52 can hinge (once the frangible sides and top edge 56*a*, 56*b*, 56*c* have been broken), is preferably formed such that it is spaced from the free-edge of the bottom rear end closure panel 34. In this way sufficient material 'M1' exists between the free-edge of the bottom rear end closure panel 34 and the hinge connection 54 such that the provision of the openable port tab 52 does not present a weak point where (unauthorized) entry could be gained into the outer sleeve 110 and such that the outer sleeve 110 retains a child-resistant quality.

The openable port tab 52 is accessed via the port aperture 50 which is formed generally within the top rear end closure panel 36 and which extends across the lateral fold line 48 and slightly into the rear closure end flap 38. The aperture 50 is formed such that each of its edges is spaced from (and not in co-incidence with) an edge of the openable port tab 52. An edge 53 of the port aperture 50 is deliberately not in line with fold line 48. An edge 51 of the port aperture 50 is deliberately not formed in registry with fold line 54 of the openable tab 52 or with the fold line 48 between the rear closure end flap 38 and top end closure panel 36. This is in order to mitigate against providing a weak point for entry which might otherwise be formed by the provision of a (non-CR) access means. Again to avoid weakening the child-resistance quality or indeed the structural integrity of the rear end wall 34/46 (because of the provision of a rear access 52/50), the aperture 50 is formed such that the material 'M2' between the fold line 46 and the edge 51 of the aperture 50 that is closest to the top rear end panel 36 is sufficiently sized such that: it can either form a strong enough bond with the material 'M1' of the bottom rear end panel 34 therebeneath to avoid tearing; or it is difficult to tear through; and/or it covers and protects part of the material 'M1'.

Finally, the blank 10 optionally also comprises front top and front bottom end flaps 30, 32, that are hinged by fold lines 40, 42 to the "open" or "front" ends of the inner top panel 12 and bottom panel 16 and respectively. These front top and front bottom end flaps 30, 32, in use are folded approximately 180° about fold lines 40, 42 and are affixed in face contacting relationship to the inner top panel 12 and bottom panel 16 respectively. Once affixed in this way, front top and front bottom end flaps 30, 32 optionally serve to provide a smooth finish to the "open" end of the outer sleeve 60 and serve to prevent or at least mitigate against the complete withdrawal of the lockable receptacle from the outer sleeve 110.

Turning to the construction of the outer sleeve 110 as illustrated in FIGS. 2, 2A, 2B and 2C, it is envisaged that the outer sleeve 110 can be formed by a series of sequential folding operations in a straight line machine so that the outer sleeve 110 is not required to be rotated or inverted to complete its construction. The folding process is not limited to that described below and may be altered according to particular manufacturing requirements.

The blank 10 may be disposed such that its printed coated side (the "outside surface") faces down and such that its uncoated, unprinted side (the "inside surface") faces out. This orientation is shown in FIG. 2. Adhesive, such as a hot melt glue or other affixing agent may be applied in the region G1 on the inside surface of the front bottom end flap 32. The front bottom end flap 32 as described above may then be folded 180° about fold line 42 to bring it into face-contacting relationship with the inside surface of the bottom panel 16 and to thereby affix the front bottom end flap 32 to the bottom panel 16.

The first compartment side panel 78*a*, together with the compartment bottom panel 76, second compartment side panel 78*b* and glue flap 80, is folded 180° about hinge connection 84 to bring the inside surface of the first compartment side panel 78*a* into face contacting relationship with the inside face of the inner top panel 12. The glue flap 80 is then folded 180° about fold line 92 to bring the outside surface of the glue flap 80 into face contacting relationship with the second compartment side panel 78*b*. The compartment bottom panel 76, together with the second compartment side panel 78*b* (and folded glue flap 80) is then folded 180° about fold line 86*a* to bring the outside surface of part of the compartment bottom panel 76 into face contacting relationship with the outside surface of the first compartment side panel 78*a* and such that the first compartment side panel 78*a* is sandwiched between the inner top panel 12 and the compartment bottom panel 76.

Adhesive, such as hot melt glue or other affixing agent may be applied on the inside surface of the front top end flap 30. The front top end flap 30 as described above may then be folded 180° about fold line 40 to bring it into face-contacting relationship with the inside surface of the inner top panel 12 and to affix the front top end flap 30 to the inner top panel 12 (See FIG. 2A).

Adhesive, such as hot melt glue or other affixing agent may be applied in the region 'G2' on the inside surface of the compartment bottom panel 76. The first side panel 14 and inner top panel 12, together with the folded compartment structure are then folded 180° about fold line 24. This brings the inside surface of the first side panel 14 into face contacting relationship with part of the inside surface of the bottom panel 16. Additionally this brings the inside surface of the inner top panel 12 into face contacting relationship with part of the inside surface of the bottom panel 16 and with part of the inside surface of the second side panel 18. Additionally, this brings the compartment bottom panel 76 into face contacting relationship with part of the inside surface of the bottom panel 16 such that it is affixed thereto. Adhesive, such as hot melt glue or other affixing agent may be applied in the region 'G4' to the inside surface of the glue flap 80 and in the region 'G3' to the outside surface of the inner top panel 12. The outer top panel 20 may then be folded about 180° about fold line 28 to bring the inside surface of the outer top panel 20 into face contacting relationship with the outside surface of the inner top panel 12 and with the compartment glue flap 80. The glue flap 80 is thereby affixed to the inside surface of the outer top panel 20. The compartment panels 78*a*, 76, 78*b*, 80 are thereby folded and affixed such that a flat-form assembly is created. This allows for the outer sleeve 110 and compartment 74 to be shipped in a flat-form (see FIG. 2C) which is more cost effective. Thereafter, the outer sleeve 110 and compartment 74 can be opened into an erect, substantially tubular form, optionally by folding the first and second side panels 14, 18 such that they are each at about 90° relative to the bottom panel 16 and top panels 12/20 respectively. In folding the outer sleeve 110 first and second side panels 14, 18 in this manner, the compartment first and second side panels 78*a*, 78*b* are automatically erected by virtue of the first and second side panels 78*a*, 78*b* being connected between the top wall 12/20 and bottom panel 16 of the outer sleeve 110 (via hinge connection 84 and glue flap 80; and via the compartment bottom panel 76 respectively).

FIG. 3 shows a perspective view of the erect outer sleeve 110 wherein the rear end wall 34/36 is open and the erected compartment 74 can be seen. FIG. 4 shows an internal view of the erect compartment 74 through a cut-away portion of the second side panel 18 of the outer sleeve 110. It can be seen that, as described above, shaped (chamfered or angled) lower, rear edges 90*a*, 90*b* are provided which will serve to guide the housing module 201 for the electronics device 205 through and into the slots. It can be seen that the slots are formed by the cuts or slits 88*a*, 88*b*, between a bottom cut edge of the compartment first and second side panels 78*a*, 78*b* and the compartment bottom panel 76 and/or the bottom panel 16 of the outer sleeve 110. The slots provide a means for interconnecting the electronic device housing module 201 (and thereby the electronic device 205 housed therein) and the outer sleeve 110.

To describe the electronic device housing module 201 in more detail, reference is now made to FIGS. 5A to 5G. Optionally, the electronic device 205 may comprise a printed circuit board (PCB) to which other electronic components, for example a power source 217 (optionally in the form of a battery); and a data exchange port 219 (optionally in the form of a USB-type port) may be electrically coupled. The nature, structure and configuration and functionality of the electronic device 205 may take a wide variety of forms in dependence upon the application of the smart package. As such, it should be recognized that the electronic device 205 described herein represents a mere example of a wide range of electronic devices that could be used in conjunction with a housing module 201, an outer sleeve 110 and lockable receptacles 329 (and those formed from the blanks 431, 431 of FIGS. 20 and 21) disclosed herein.

Figures 18, 18A, 19, 19A:
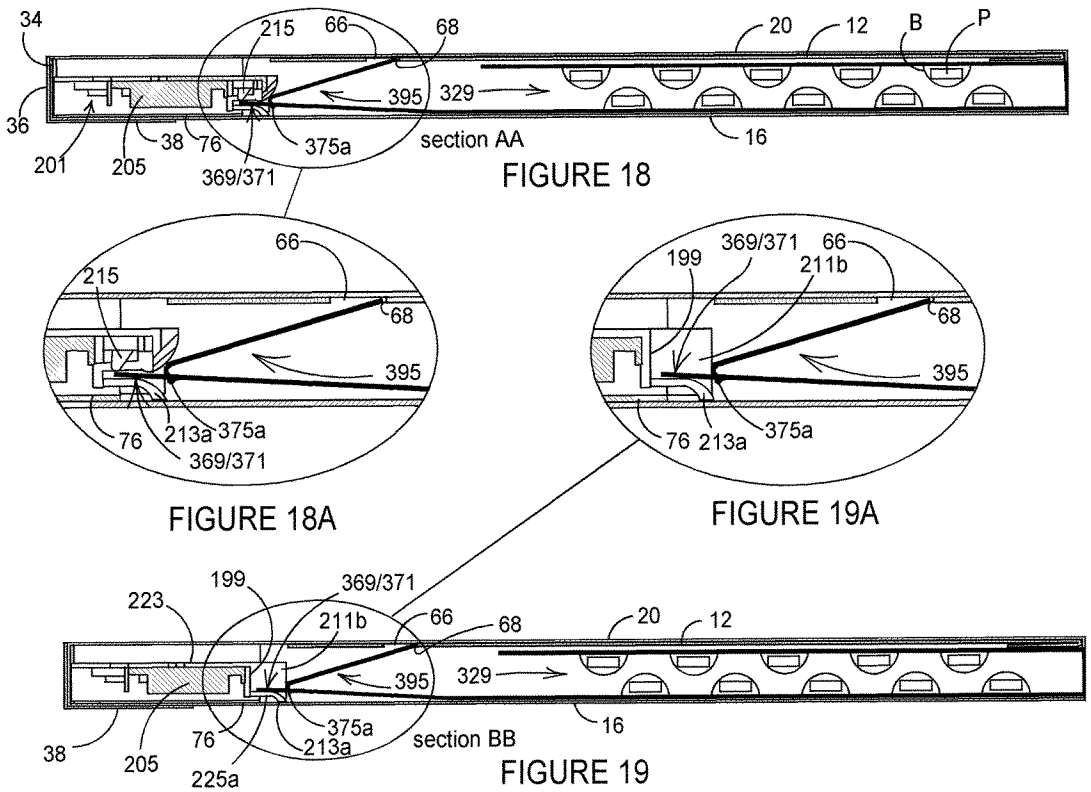
FIG. 18 is a cross-sectional view taken along the line AA shown in FIG. 17.
FIG. 18A is an enlarged view of part of the cross-sectional view shown in FIG. 18.
FIG. 19 is a cross-sectional view through a cut-away side wall of the package of FIG. 17 taken along the line BB shown in FIG. 17.
FIG. 19A is an enlarged view of part of the cross-sectional view shown in FIG. 19.

The electronic device 205 additionally comprises the detector 215 which in the present arrangement is a mechanical switch; optionally a micro-switch that is pressed inwardly into a section of the electronics device 205 by the presence of the tab 369/371 in the slot 231. When not engaged, an exposed portion of the detector 215 may biased to depend into the slot 231 (see FIG. 5D). In cross-section the exposed portion of the detector 215 may have a substantially rounded "V"-shape. The exposed portion of the detector 215 is pivotally movable, such that a front most face thereof (the face closest to the front end of the outer sleeve 110 in a loaded configuration), moves rear ward and upward and is disposed within the section of the electronics device 205 by virtue of being pushed by the tab 369/371 when disposed in the slot 231. (This is best illustrated in FIG. 18A, especially when contrasted against FIG. 5D). Once depressed by the tab 369/371 an electrical connection may be closed (or opened depending upon the nature of the circuitry of the electrical micro-switching mechanism) in order to register the presence of the lockable receptacle 329.

Optionally, the electronic device 205 comprises a data exchange port 219 and to facilitate use of the data exchange port 219, the outer sleeve 110 is provided with the rear access 50/52. However, in envisaged embodiments, the electronic device does not comprise a data port requiring a physical mechanical connection, (for example, because it is configured to transmit data wirelessly) and in such embodiments, no rear access 50/52 is provided. The rear end closure flap 38 may nevertheless be provided to permit a strong manual closure of the outer sleeve whether a rear access 50/52 is provided or not. In further envisaged embodiments the rear end closure flap is not provided.

Referring again to FIG. 5A, the housing module 201 (which may also be referred to as a "sled") comprises a main body and is optionally a one-piece unitary molded construct formed from plastics material. The housing module 201 comprises a top wall 223 (see FIGS. 5B, 5E and 5F for best views); a sled first side wall 209*a*; a sled second wall 209*b*; and a sled front wall 199. The sled first and second walls 209*a*, 209*b* depend, at approximately 90° from each side of the sled top wall 223 and together with the sled top wall 223 and sled front wall 199 provide a generally rectangular (cuboid) form which defines a primary "foot-print" of the sled 201.

Beneficially, the sled 201 is provided with retention wings 203*a*, 203*b*, (which may also be referred to as "runners" 203*a*, 203*b*). Optionally, the retention wings 203*a*, 203*b* each terminate in line with a rear edge of the top wall 223 and a rear edge of the sled first and second side walls 209*a*, 209*b*, such that the shape of the rear end of the housing module 201 approximates the shape of a top-hat (see FIG. 5E). The runners 203*a*, 203*b* are substantially planar and substantially uniform in thickness such that they can be glided into the slots provided by cuts 88*a*, 88*b* in the receiving compartment 74 of the outer sleeve 110. The thickness of the runners 203*a*, 203*b*, relative to the depth of the slot formed by slits 88*a*, 88*b* ensures a friction fit therebetween to hold the housing module 201 in place within the receiving compartment 74. The runners 203*a*, 203*b* extend or project beyond the primary foot-print defined by the sled first and second walls 209*a*, 209*b*; and sled front wall 199.

Further beneficially, each runner 203*a*, 203*b* has a leading tip 207*a*, 207*b* shaped and arranged to provide a recess, hook, or "V" shape such that when each runner 203*a*, 203*b* is passed into the slot provided by cut line 88*a*, 88*b*, when the hook reaches the end of the slot, it abuts the compartment first or second side panel 78*a*, 78*b* respectively to limit further movement of the housing module 201 into the compartment 74. In this way, correct location of the housing module 201 (and thereby detector 215 of the electronics components 205 affixed thereto) is easily ensured. The extent to which the housing module 201 can be pushed into the receiving compartment 74 is therefore controlled in a longitudinal direction. The compartment first and second side walls 78*a*, 78*b* confine the housing module 201 in a lateral direction. The detector 215 is therefore positioned in a precise location so that it can receive the registration mechanism 369/371 of the lockable receptacle 329 (described in further detail below).

Each sled first and second side wall 209*a*, 209*b* is provided with an optionally contiguous stop rib 211*a*, 211*b*. Each stop rib 211*a*, 211*b* extends beyond the plane of the front wall 199 and as such beyond the primary foot-print or notional perimeter of the housing module 201. Each stop rib 211*a*, 211*b* is optionally angled or curves inwardly towards the other stop rib 211*a*, 211*b*. Each stop rib 211*a*, 211*b* optionally comprises a uniform thickness, which is optionally the same thickness as the sled first or second side wall 209*a*, 209*b* from which it extends. The stop ribs 211*a*, 211*b* are preferably in line with one another laterally (in other words, the stop ribs 211*a*, 211*b* terminate on the same lateral axis). The stop ribs 211*a*, 211*b* have a length determined such that they provide a stopping mechanism or a limiter at a predetermined longitudinal location relative to the rear end of the outer sleeve 110 (best viewed in FIGS. 16 and 17). The stop ribs 211*a*, 211*b* are sized, shaped, configured and positioned to limit the extent to which the lockable receptacle 329 can be pushed (from the front end) into the outer sleeve 110 and thereby ensure the correct location of the registration mechanism 369/371 of the lockable receptacle 329 relative to the detector 215 of the electronics device 205 disposed within the housing module 201 when the lockable receptacle 329 is in a locked position. The stop ribs 211*a*, 211*b* are formed such that their size, shape, position and form does not interfere with the correct location of the registration mechanism 369/371 relative to the detector 215. By being formed as extensions of the sled first and second side walls 209*a*, 209*b*, the stop ribs 211*a*, 211*b* are robust and strong and easily formed. To place abutting ends of the stop ribs 211*a*, 211*b* at an optimal location relative to the locking receptacle 329 (i.e. either side of the registration mechanism 369/371), the stop ribs 211*a*, 211*b* are optionally inwardly angled or curved. However, it is envisaged that in other embodiments, one or each stop rib 211*a*, 211*b* may extend from the front wall 199 of the housing module 201; and/or may not curve or angle toward the other stop rib but rather may angle away from the other stop rib or be straight. It is envisaged that the stop ribs may comprise a non-uniform thickness and/or may optionally be thicker at the abutting end (for example, the stop ribs in other arrangements may have T-shaped, or wedge shaped heads for example).

The housing module 201 also comprises a guiding mechanism for assisting with the proper location of the registration mechanism 369/371 relative to the detector 215. The guiding mechanism comprises one or more, in this illustrated embodiment, two, lifting teeth 213*a*, 213*b*. Each lifting tooth 213*a*, 213*b* is optionally integrally molded as an extension of the sled front wall 199. A portion of each lifting tooth 213*a*, 213*b* proximate to the sled front wall 199 is disposed in spaced alignment with the detector 215. A registration mechanism 369/371 is located within a gap or registration slot 231 that is provided generally between the lifting teeth 213*a*, 213*b* and the detector 215 (see FIGS. 5D, 17 and 18-19).

Each lifting tooth 213*a*, 213*b* has a tip end that is down turned and extended beyond a notional plane 198 in which lower edges of the sled first and second side walls 209*a*, 209*b* and/or sled front wall 199 of the housing module 201 rest. Reference is made to FIGS. 5C and 5D (which show a view taken along the line AA of FIG. 5B and an enlarged portion thereof respectively). The plane 198 in which lower edges of the sled front wall 199 and sled first and second side walls 209*a*, 209*b* rest, is indicated. An arrangement wherein the tip end of the lifting teeth 213*a*, 213*b* extends below the plane 198 is particularly beneficial in the presently described arrangement, wherein the receiving compartment 74 of the outer sleeve 110 comprises a compartment bottom panel 76 and the lower edges of the sled first and second side walls 209*a*, 209*b* and sled front wall 199 are in contact with and are supported by the compartment bottom panel 76. The feature of each lifting tooth 213*a*, 213*b* having a tip end that can reach to the floor (provided by bottom panel 16) of the outer sleeve 110 (which can also be seen in FIG. 5G) provides a continuous lifting, ramped guide for a lockable receptacle 329 that slides along that floor (the outer sleeve bottom panel 16). An underside surface 225*a*, 225*b* of each lifting tooth 213*a*, 213*b* is optionally arched or curved to provide a smooth ramp over the compartment bottom panel 76 to the bottom panel 16 of the outer sleeve 110.

Additionally or alternatively, the upper or top surface of each tip end of each lifting tooth 213*a*, 213*b* has a rounded, sloping end surface to prevent the registration mechanism 369/371 from colliding into, and thereby being stuck at, the tip ends of the lifting teeth 213*a*, 213*b* that might otherwise occur. In this way, the lifting teeth 213*a*, 213*b* enable the registration mechanism 369/371 to be smoothly lifted and guided into registration with the detector 215. The sloping direction and/or end tip shape is not limited to that illustrated. In an alternative embodiment (see FIGS. 22A-22D described below) an outer corner of each lifting tooth 613*a*, 613*b* is chamfered. In yet further envisaged and non-illustrated embodiments, the opposite corner of each lifting tooth may be chamfered instead.

Figure 6:
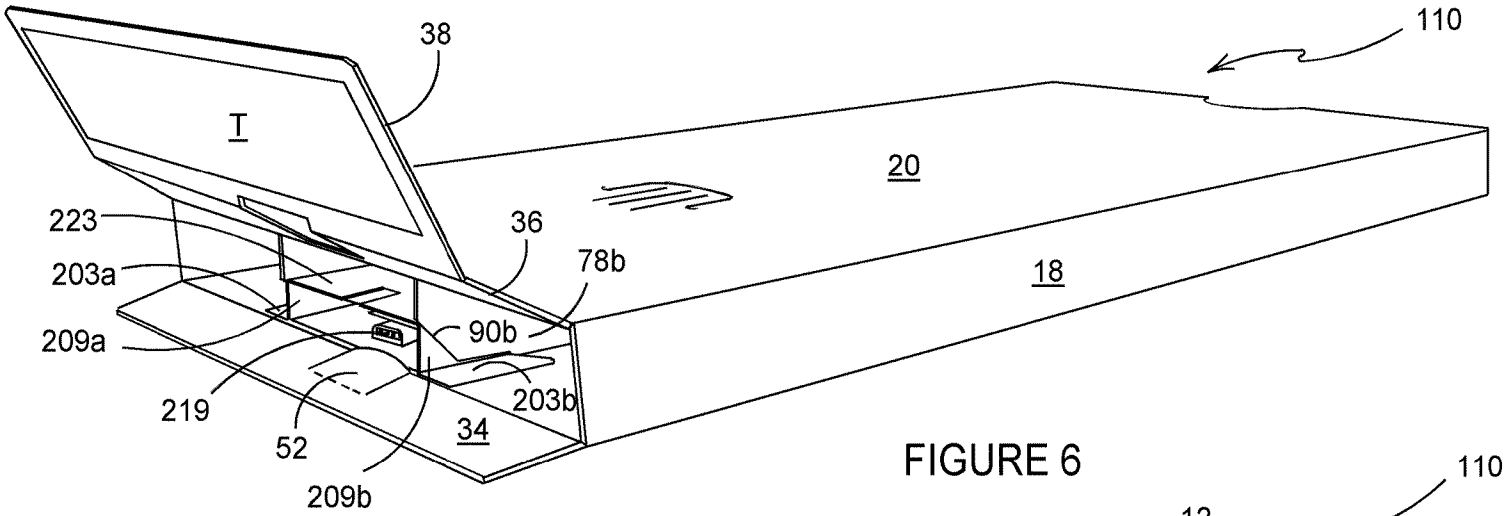
FIG. 6 is a perspective view from above of the outer sleeve of FIGS. 3 and 4, showing the housing module and its electronic device of FIGS. 5A 5G loaded into the electronic device receiving compartment thereof.
Figure 7:
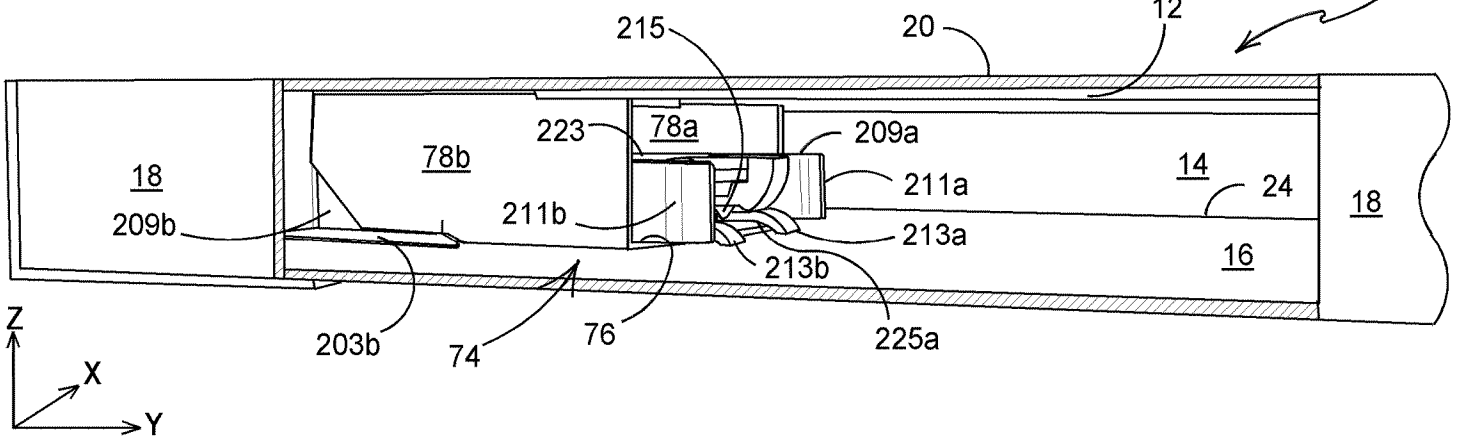
FIG. 7 is an internal perspective view through a cut-away side wall of the outer sleeve of FIG. 6, wherein the rear-end wall has been closed and the housing module and electronic device of FIGS. 5A 5G has been loaded into the electronic device receiving compartment thereof.

Referring to FIGS. 6 and 7, it can be seen that as the housing module 201 and electronic device 205 are together, as a unit, slid into the compartment 74, through the open rear-end of the outer sleeve 110. The runners 203*a*, 203*b* slide on the bottom panel 16 of the outer sleeve 110 and the sled first and second side walls 209*a*, 209*b* slide along and against internally positioned (and optionally coated) surfaces of the compartment first and second side panels 78*a*, 78*b* respectively. At the same time, the runners 203*a*, 203*b* slide along the internal surface of the bottom panel 16. It is an internal corner formed between the sled first and second walls 209*a*, 209*b* and the runners 203*a*, 203*b* that is received in the slot (formed by cut lines 88*a*, 88*b*). Once fully inserted, lateral movement (in the direction of the x-axis shown in FIG. 7) of the housing module 201 is prevented by the compartment first and second side walls 78*a*, 78*b* and the friction fit of the runners 203*a*, 203*b* mitigates against the housing module 201 simply falling free of the open rear-end outer sleeve 110. Furthermore, the runners 203*a*, 203*b* being slotted beneath the compartment first and second side walls 78*a*, 78*b* restricts movement of the housing module in the direction of the z-axis indicated on FIG. 7.

The inter-connection of the housing module 201 and outer sleeve 110 is further enhanced by the lifting feet 213*a*, 213*b* having arched undersides 225*a*, 225*b* and extending beyond and over an innermost edge of the compartment bottom panel 76. This is best seen in FIG. 7 wherein the position of a housing module 201 fully inserted into the internal compartment 74 is shown. It can be seen that tip ends of lifting teeth 213*a*, 213*b* come to rest on the bottom panel 16 of the outer sleeve 110. During insertion, the lifting teeth 213*a*, 213*b* may flex slightly upwardly so that they can be slid along the compartment bottom panel 76 (depending upon how much headroom there is above the housing module 201 within the compartment 74). Then, once they are moved past the compartment bottom panel 76, the lifting feet 213*a*, 213*b* relax and may slightly snap-fit into the position shown in FIG. 7. The lifting feet 213*a*, 213*b* may catch, abut or engage against the edge of the compartment bottom panel 76 and may thereby prevent accidental egress of the housing module 201. The lifting feet 213*a*, 213*b* may thereby restrict longitudinal movement (in the direction of the y-axis) out of the rear end of the outer sleeve 110. Longitudinal movement (along the y-axis) further into the outer sleeve 110 is prevented by the hook shaped portions of the runners abutting the compartment first and second side panels 78*a*, 78*b* and the housing module 201 is mechanically locked in place.

To withdraw the housing module 201*a* deliberate rearward force is required to overcome the friction fit and optionally to move the lifting feet 213*a*, 213*b* upwardly to clear the edge of the compartment bottom panel 76. Whilst this is not complicated, it typically can only be achieved deliberately and thus inadvertent egress of the housing module 201 is prevented.

The interconnection of the housing module 201 and outer sleeve 110 without the need for adhesive or other affixing means is beneficial because the electronic device 205 can easily be removed for re-use when removal is intended without having to break adhesive bonds or unravel any auxiliary mechanical fixings.

Turning now to the lockable receptacle 329 and to a first illustrated embodiment, thereof, reference is now made to FIGS. 8 to 15C. Slidable, lockable receptacles for housing product 'P', optionally in individual blisters 'B' formed together in a blister strip 393*a*, 393*b* are known and it will be recognized that adaptation of many different types of existing slidable lockable receptacle by application of the inventive features for lockable receptacles disclosed herein can be carried out and as such, the present aspect of the disclosure is not limited in its application to a lockable receptacle entirely of the form illustrated herein.

Therefore it is entirely optional that the lockable receptacle 329 comprises a two-ply body having two sections, one folded above the other and a locking tail flap 395 which provides the second part of the two-part complementary locking mechanism. Indeed in other envisaged embodiments, the lockable receptacle is single-ply with a non-folded main body and is of the form of a blister strip having an integral locking tail flap or foot.

The lockable receptacle 329 of the presently illustrated exemplary embodiment is slidably insertable through an open end of the outer sleeve 110 and is securably locked therein by operation of the two-part complementary locking mechanism. The locking operation of the two-part locking mechanism is illustrated in FIGS. 16, 18, 18A, 19 and 19A.

Figure 8:
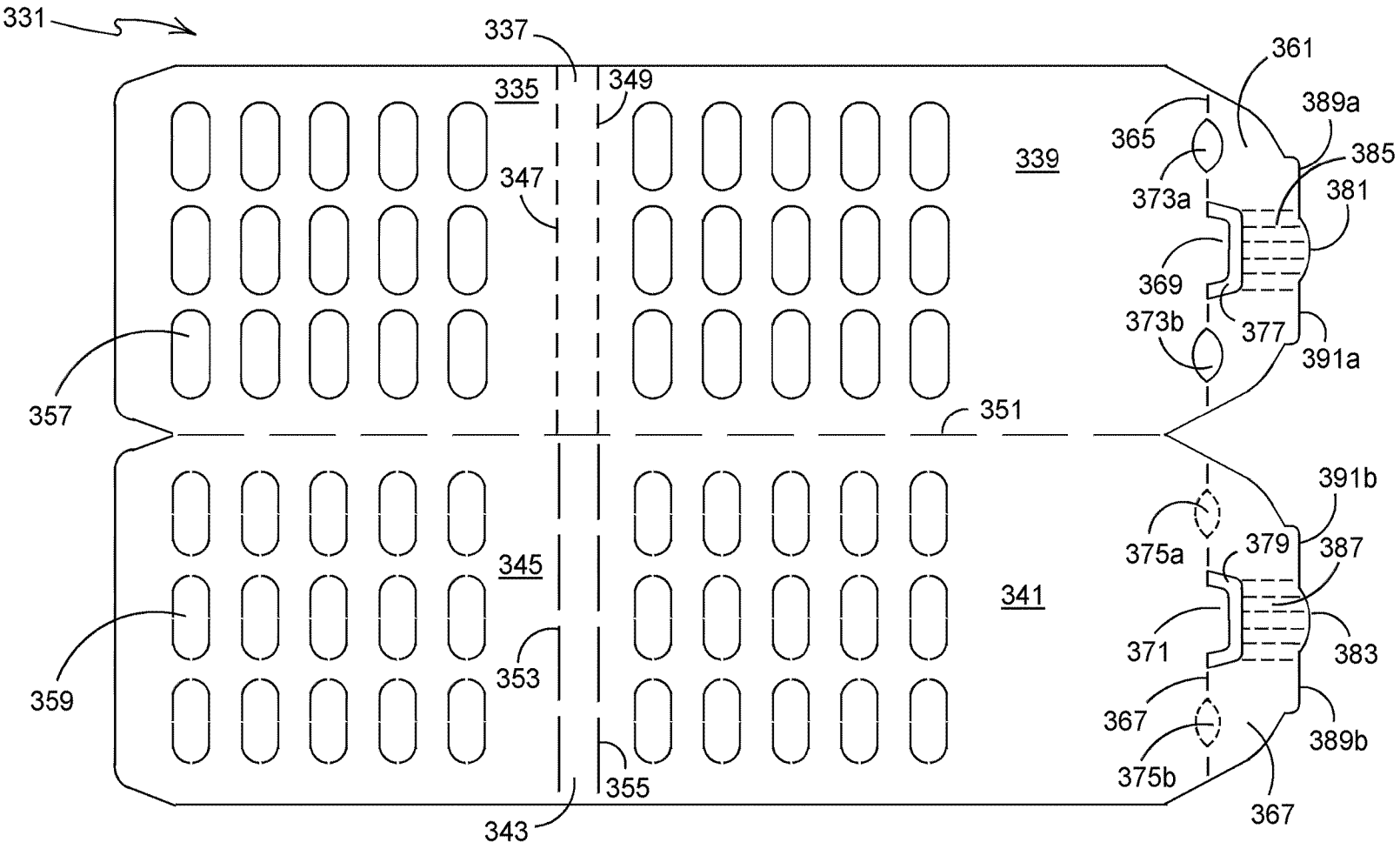
FIG. 8 is a plan view from above of a blank for forming a lockable receptacle according to an aspect of the disclosure.

Turning to the optional structure of the lockable receptacle 329 shown herein, reference is made specifically to FIG. 8 wherein a blank 331 of suitable substrate is provided for forming a 2-ply slide card which holds products 'ID' disposed in blister strips 393*a*, 393*b* (see FIGS. 9 and 10) sandwiched therein. The blank 331 comprises a first top panel 339, a first bottom panel 341 and a second top panel 335 and a second bottom panel 345 hinged thereto along longitudinally extending fold line 351. The first and second top panels 339, 335 each comprise an array of blister shaped apertures 357 cut therein, each aperture for receiving a blister 'B' of a blister strip 393*a*, 393*b*. The first and second top panels 339, 335 are spaced and connected by a first spine panel 337. A first hinge connection 349 connects the first spine panel 337 to the first top panel 339; and a second hinge connection 347 connects the first spine panel 337 to the second top panel 335.

The first and second bottom panels 341, 345 each comprise an array of blister shaped frangible sections 359 formed therein. Each blister shaped frangible section 359 provides a gateway to a frangible (optionally foil, paper or plastics) film 'F' of the blister strips 393*a*, 393*b*. The first and second bottom panels 341, 345 are spaced and connected by a second spine panel 343. A first hinge connection 355 connects the second spine panel 343 to the first bottom panel 341; and a second hinge connection 353 connects the second spine panel 343 to the second bottom panel 345.

Hinged to each end of the first top and first bottom panels 339, 341 are first and second locking tail flap panels 361, 363 respectively. Each locking tail flap panel 361, 363 is substantially similar to the other locking tail flap panel 363, 361 to which is to be affixed in forming the locking tail flap 395 of the lockable receptacle 329 (see FIGS. 14 to 19). Each locking tail flap panel 339, 341 has a leading free-edge 389*a*, 381, 391*a*; 391*b*, 383, 389*b* that is shaped such that at least part of it mates with the first part of the two-part complementary locking mechanism 64 in the outer sleeve 110 (provided by the "sting-ray" shaped aperture 66 and locking edge 68). The first and second locking tail flap panels 361, 363 are each hingedly connected to the adjacent first top and bottom panels 339, 341 by hinge connections 365, 367 respectively. Optional ribs 385, 387, demarcations, line formations or other suitable depressions may be provided.

In the present arrangement, the registration mechanism is optionally a two-ply pushing tab 369/371 formed from tab panels 369 and 371 respectively. The tab panels 369, 371 are each integrally anchored, preferably in a crease-free and contiguous manner to the adjacent first top panel 339 and first bottom panel 341 respectively. The tab panels 369, 371 are formed from material that otherwise would have formed part of the adjacent locking tail flap panel 361, 363 and are optionally defined in part by apertures 377, 379 that are struck into the adjacent locking tail flap panel 361, 363. The tab panels 369, 371 optionally are substantially trapezoidal in end profile shape and interrupt the hinge connections 365, 367. Each locking tail flap panel 361, 363 is substantially symmetrical in form, with the tab panels 369, 371 being formed substantially centrally.

In addition to or as part of the registration mechanism 369/371, a raising arrangement 373*a*, 373*b*, 375*a*, 375*b* is provided to lift or raise at least a leading tip portion of the two-ply pushing tab 369/371 to assist in the registration mechanism 369/371 being guided by the lifting teeth 213*a*, 213*b*. This may further ensure the correct positioning of the registration mechanism 369/371 relative to the detector 215 of the electronic device 205 and indeed may further ensure that the detector 215 is fully depressed inwardly to close (or open) the electrical connection as required. In the present embodiment, the raising arrangement comprises: a pair of leaf-shaped cuts 373*a*, 373*b* interrupting the hinge connection 365 between the first top panel 339 and the first locking tail flap panel 361; and a pair of leaf-shaped fold, crease or partial cut lines defining two leaf shaped panels 375*a*, 375*b* interrupting the hinge connection 367 between the first bottom panel 341 and the second locking tail flap panel 363.

To form a completed product holding lockable receptacle 329, blister strips 393*a*, 393*b* are placed on to the (un-coated and/or un-printed) inside surfaces of the first and second bottom panels 341, 345. See FIG. 11, wherein it can be seen that a top side 'Ti' of each blister strip 393*a*, 393*b* faces upwardly and such that a backing film 'F' (which may be a paper, foil, plastics or other suitably formed film) is next to the array of blister shaped frangible sections 359 formed in the first and second bottom panels 341, 345. The blister strips 393*a*, 393*b* may be affixed by means of an adhesive bond, in between the blister shaped frangible sections 359, to the first and second bottom panels 341, 345 respectively. Adhesive may be applied to the first and second top panels 339, 357 and/or to the remaining exposed areas of the inside surfaces of the first and second bottom panels 345, 341; to the first and/or second spine panel 337, 343; to the inside surfaces of the locking tail flap panel 361 and/or locking tail flap panel 363; and to the inside surfaces of one or both of the tab panels 369, 371.

Figures 9, 10, 11, 12, 13, 14, 15:
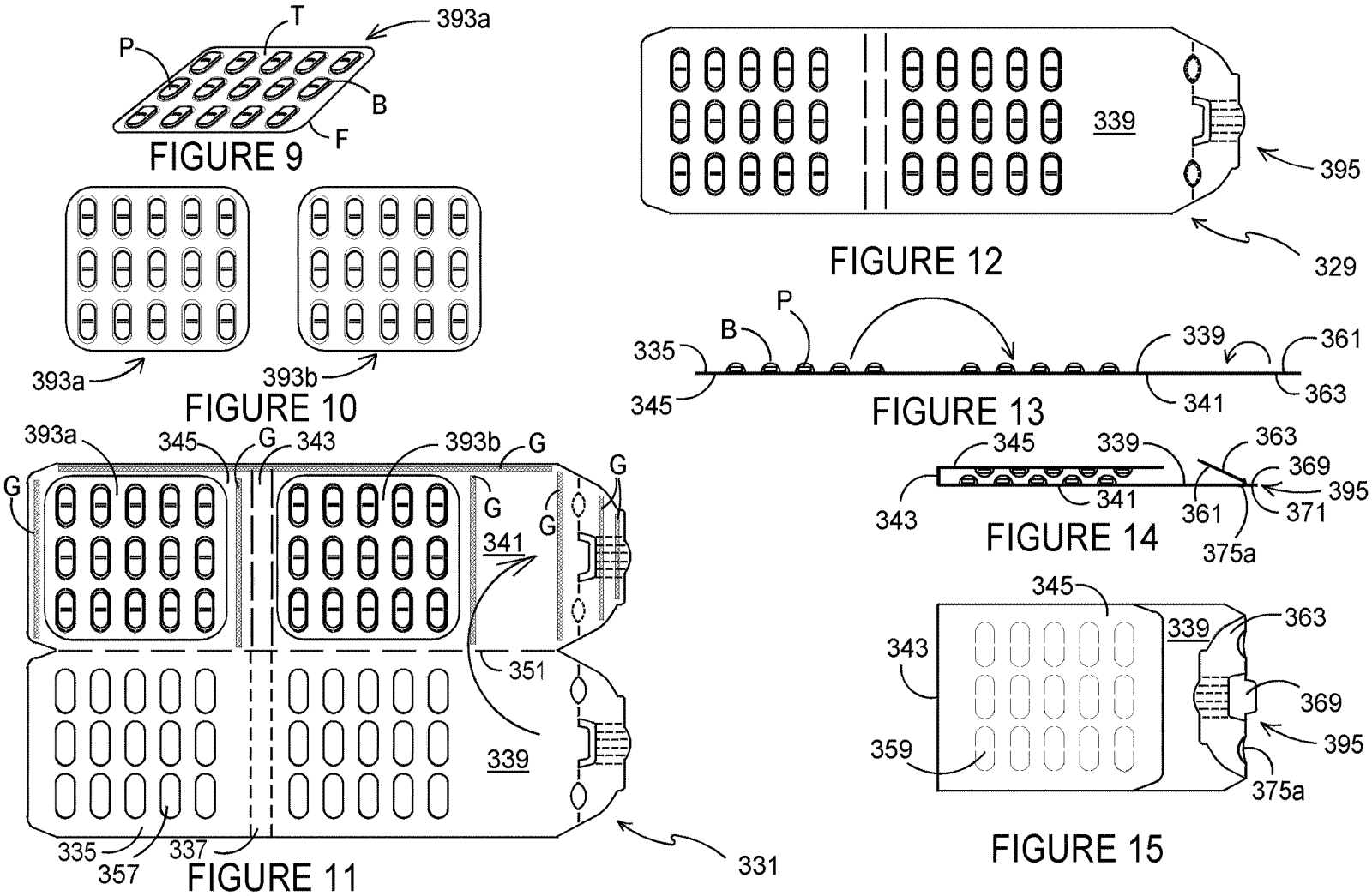
FIG. 9 is a perspective view from above of a product holding blister strip.
FIG. 10 is a plan view of two product holding blister strips of FIG. 9.
FIG. 11 is a plan view from above of the two product holding blister strips of FIG. 10 disposed on top of an inside surface of the blank of FIG. 8.
FIG. 12 is a plan view from above of a lockable receptacle formed from the blank of FIG. 8 and having the two product holding blister strips of FIG. 10 secured therein, the lockable receptacle is shown in an open (un-folded) position.
FIG. 13 is a side view of the lockable receptacle of FIG. 12 shown in the open (un-folded) position.
FIG. 14 is a cross-section of the lockable receptacle formed from the blank of FIG. 8 and having the two product holding blister strips of FIG. 10 secured therein, wherein the lockable receptacle is shown in a folded position.
FIG. 15 is a top plan view of the folded lockable receptacle of FIG. 14.

The blank 331 is then folded about longitudinal fold line 351 to bring the first top panel 339, first spine panel 337, second top panel 335, first locking tail flap panel 361 and tab panel 369 into face contacting and affixed relationship with at least parts of the first bottom panel 341, second spine panel 343, second bottom panel 345, second locking tail flap panel 363 and tab panel 371. This is shown in FIG. 12. The locking receptacle 329 thereby formed is then folded (about fold lines 349/355; 347/353; and 365/367, to bring the second top and bottom panels 335, 345; and the locking tail flap 395 into superposed relationship with the first top panel 339 (see FIGS. 13, 14 and 15).

Figure 15A:
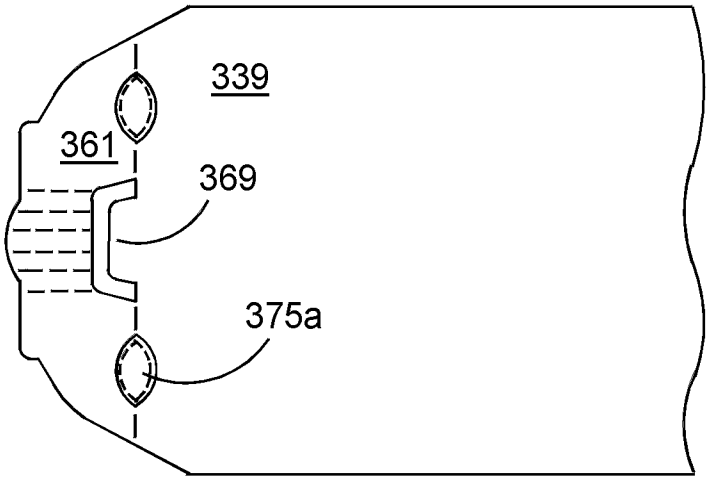
FIG. 15A is a top plan view of part of the lockable receptacle of FIG. 12 showing an enlarged view of the locking tail flap and a raising arrangement.
Figure 15B:
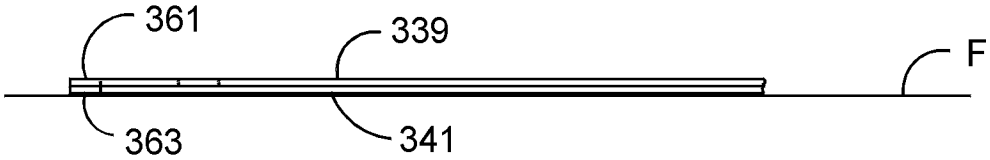
FIG. 15B is a side view of the un-folded lockable receptacle of FIG. 15A shown on a flat surface.
Figure 15C:
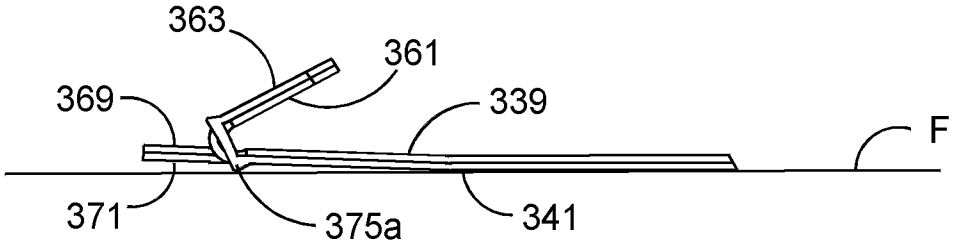
FIG. 15C is a side view of the lockable receptacle of FIG. 15B shown on a flat surface and shown with the locking tail flap folded and the raising arrangement acting to raise the registration mechanism in readiness for registration with a detector of the electronic device of FIGS. 5A to 5G.
Figure 16:
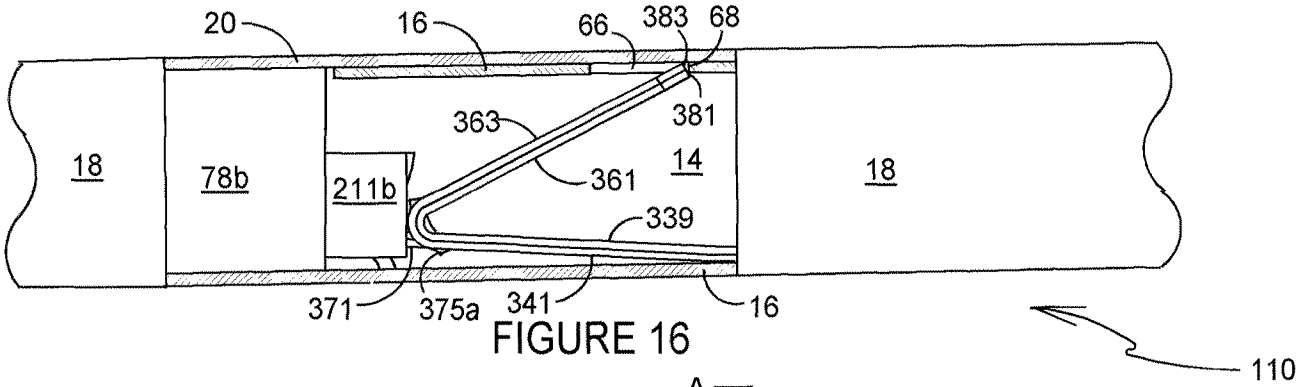
FIG. 16 is an internal side view through a cut-away side wall of a package comprising the outer sleeve of FIG. 7, wherein the housing module and electronic device of FIGS. 5A 5G have been loaded into the electronic device receiving compartment of the outer sleeve, and comprising the folded lockable receptacle of FIGS. 14 and 15A-C, the lockable receptacle is shown fully inserted into the outer sleeve, locked therein and disposed in a registration position relative to the housing module and electronic device.
Figure 17:
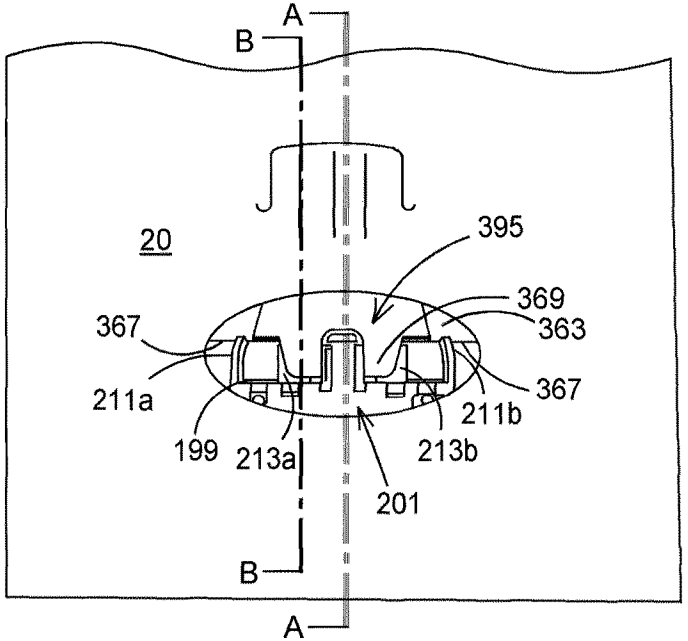
FIG. 17 is a top plan view of the package of FIG. 16 through a cut away portion of a top wall of the outer sleeve showing the lockable receptacle in the registration position relative to the housing module and electronic device.

The raising arrangement is formed at, along or proximate to the hinged connection 365/367 between the locking tail flap 395 and the body 339/341/337/343/335/345 of the lockable receptacle 329 once the lockable receptacle 329 has been constructed from the blank 331. The raising arrangement provides the benefit of raising at least the leading tip end of the two-ply pushing tab 369/371 slightly when the locking tail flap 395 is folded so that smooth movement of the two-ply pushing tab 369/371 onto the lifting teeth 213*a*, 213*b* is facilitated. This is illustrated in FIGS. 15B and 15C, wherein the unfolded flat-from of lockable receptacle disposed on a floor 'F' (see FIGS. 15B and 15C) is contrasted with the folded form of the same lockable receptacle 329 on the same floor 'F'. In the presently illustrated embodiment, the folding resistance of the locking tail flap 395 may be increased by the presence of the leaf-shaped panels 375*a*, 375*b*, at least in the region of the leaf-shaped panels 375*a*, 375*b*. The leaf-shaped panels 375*a*, 375*b* form a panel portion interrupting the hinge connection 365/367 and may bulge a little out of the line of the hinge connection 365/367 to provide a bump that contacts the floor 'F' and which thereby pushes a portion of the lockable receptacle 329 up slightly to lift the tab 369/371. Also see FIGS. 14, 18A and 19A wherein the lower bumps formed by the leaf shaped panels 375*a*, 375*b* are shown bulging slightly below the line of the hinge connection 365/367 and as a consequence, the two-ply pushing tab 369/371 is shown raised slightly.

The folded form of the lockable receptacle 329 (loaded with products 'F") is then ready for insertion into the outer sleeve 110. The lockable receptacle 329 is inserted through the open front end of the outer sleeve 110, leading with the folded edge 365/367. As the lockable receptacle 329 is inserted, the two-ply pushing tab 369/371 approaches the housing module 201 and electronics device 205 in a slightly lifted position (see FIGS. 16, 18, 18A, 19 and 19A). In co-ordination therewith the rounded, ramped form of the lifting teeth 213*a*, 213*b* guide and further raise the pushing tab 369/371 up toward and into the slot 231 between the detector section and upper surface of the lifting teeth 213*a*, 213*b*. Once the lockable receptacle 329 has travelled into the cavity of the outer sleeve 110 sufficiently to activate the detector 215 (optionally by pressing it inwardly) the folded edge 365/367 contacts the stopping ribs 211*a*, 211*b* (see FIG. 16 in particular and also FIGS. 17, 19 and 19A), and further travel of the lockable receptacle 329 into the cavity of the outer sleeve 110 is prevented. Such further travel particularly mitigates against crushing or crashing of the paperboard tab 369/371 and therefore increases the repeatable usefulness of the paperboard tab 369/371. If a reinforcing mechanism is provided for the tab 369/371 and/or if some or all of the tab 369/371 is not formed from paperboard but from a more resilient material (such as plastic) then the stopping ribs 211*a*, 211*b* may not be required. Nevertheless in beneficial applications of the present disclosure, the tab 369/371 is formed from paperboard and the hinge connection 365/367 contacting the stopping ribs 211*a*, 211*b* is beneficial.

Once the locking tail flap 395 reaches the aperture 66, it is able to unfold slightly because of the presence of the aperture 66 (see FIGS. 16, 18, 18A, 19 and 19A). The free-edge 381, 383 of the locking tail flap 395, opens into the aperture 66 and abuts the locking edge 68. The lockable receptacle 329 is thereby locked within the outer sleeve 110.

In this fully inserted and locked position (see FIGS. 16, 17, 18 and 18A) the registration mechanism 369/371 is disposed in the slot 231 and relative to the detector 215 such that the detector 215 is able to sense the presence of the lockable receptacle 329. A data storage device may record the date and time that the lockable receptacle 329 was inserted. Other data may be collected.

To enable the lockable receptacle 329 to be withdrawn, a user must activate the release mechanism 58. In depressing the release tab 60 onto inner tab 70, the locking tail flap 395 is in turn depressed and moved out of the aperture 66 and out of engagement with the locking edge 68. By simultaneously pulling on the opposite end of the lockable receptacle 329 (utilizing thumb recesses formed in the fold lines 40, 42) a user can slidably withdraw the lockable receptacle 329 from the outer sleeve 110 and access the products 'P' housed in the blisters 'B'. In doing so, the registration mechanism 369/371 is removed out of the slot 231, moved away from the detector 215 (which may then drop back into the slot 231 and open (or close) an electrical connection) and the removal of the lockable receptacle 329 is sensed. A data storage device may record the date and time that the lockable receptacle 329 was removed and an inference that can be made is that a user removed a product 'P' at that time and their compliance with a treatment plan thereby tracked. Preferably, the lockable receptacle 329 is prevented from being fully withdrawn from the outer sleeve 110 by engagement of the leading free-edge 381, 383 of the locking tail flap 395 with the front top end flap 30.

To mitigate against collection of false data, (which may for example be gathered if the acts of a user familiarizing themselves with the operation of the package are recorded and interpreted to mean many products were withdrawn within a very short time of one another), an algorithm running on a microchip associated with the electronic device 205 may be used to qualify the data. As referred to above, the nature of the electronic device 205, its configuration and functionality are not the focus of the present disclosure. Indeed, the detector 215 may, for example, be a mechanical micro-switch that is depressed by the presence of the tab 369/371 in the slot 231. Alternatively, the detector 215 may, for example, be an electrical detector responsive to a change in an electrical property (resistance/capacitance) due to the presence of the tab 369/371 in the slot 231. Alternatively, the detector 215 may, for example, be an optical sensor responsive to a change in an optical characteristic due to the presence of the tab 369/371 in the slot 231. Many variations are envisaged for the electronic device and the arrangement of electronic device, its components and functionality as described herein should not be considered in any way as limiting the application of the smart package and components thereof (the outer sleeve 110, lockable receptacle 329 and/or housing module 201 as described and illustrated herein) as being limited in application to such an electronic device.

Referring now to FIGS. 20, 20A, 20B, 20C and 21, there are shown blanks 431, 531 for forming lockable receptacles (not shown) having alternative embodiments of raising arrangements according to an aspect of the present invention. In these embodiments, like numerals have, where possible, been used to denote like parts, albeit with the addition of the prefix "400" or "500" to indicate that these features belong to the alternative embodiments. The alternative embodiments share many common features with the first embodiment and therefore only the differences from the embodiment illustrated in FIGS. 8 to 15C will be described in any greater detail.

Figure 20:
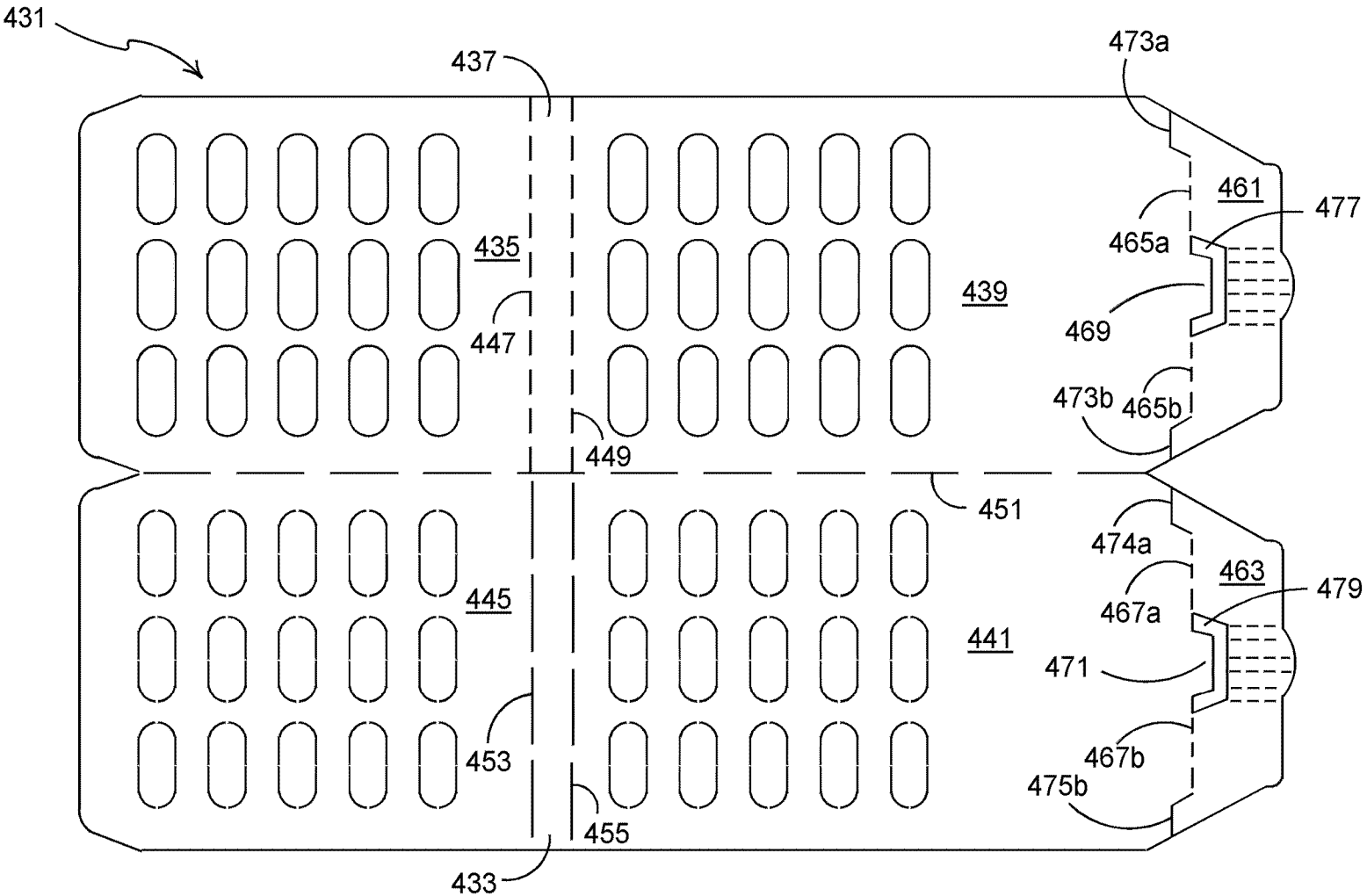
FIG. 20 is a plan view from above of a blank for forming a lockable receptacle according to another aspect of the disclosure.
Figure 20A:
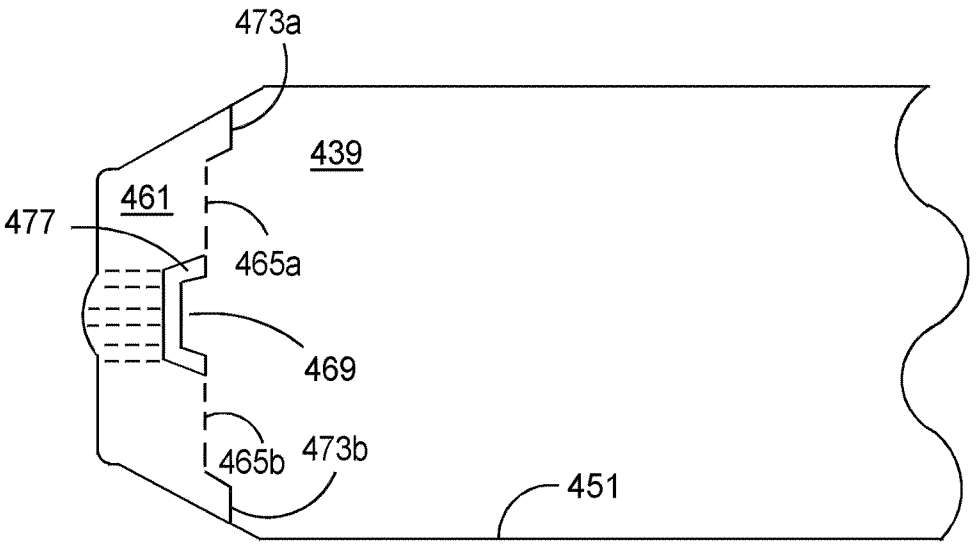
FIG. 20A is a top plan view of part of the lockable receptacle formed from the blank of FIG. 20 showing an enlarged view of the locking tail flap and a raising arrangement.
Figure 20B:
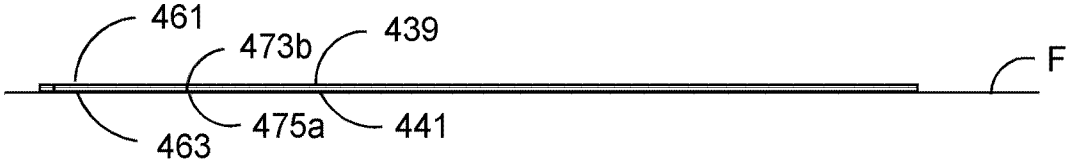
FIG. 20B is a side view of the un-folded lockable receptacle of FIG. 20A shown on a flat surface.
Figure 20C:
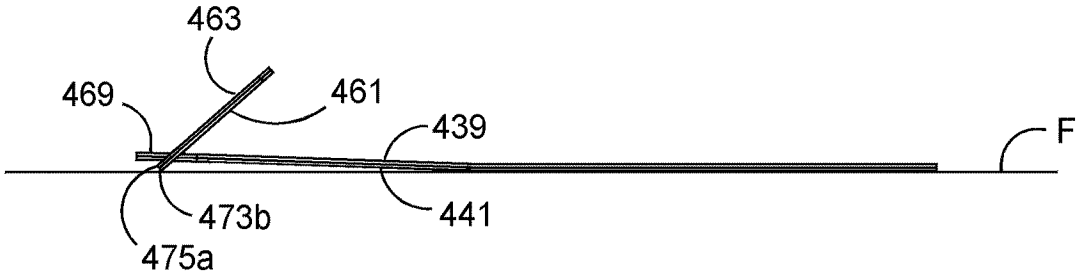
FIG. 20C is a side view of the lockable receptacle of FIG. 20B shown on a flat surface and shown with the locking tail flap folded and the raising arrangement acting to raise the registration mechanism in readiness for registration with a detector of an electronic device.

In FIG. 20, the raising arrangement comprises square or flat-ended feet 473*a*/475*a*, 473*b*/475*b* of the locking tail flap panels 461, 463. The feet 473*a*/475*a* are partially struck from the first top panel 439 and first bottom panel 441 of the blank 431. The feet 473*a*/475*a*, once formed, are two-ply and project beyond the hinge connection 465*a*/465*b*/467*a*/467*b* and provide means for lifting the registration mechanism (the two-ply pushing tab) 469/471. The optionally two-ply feet 473*a*/475*b*, 473*b*/457*a* are each formed by cut lines. A cut line angled away from the hinge connection 465*a*, 465*b*, 467*a*, 467*b* and one cut line substantially parallel thereto (which defines a lower most, standing edge, of the feet). When the locking tail flap 461/463 is formed and folded about hinge connection 465*a*/465*b*/467*a*/467*b*, two projecting feet are formed that abut a floor 'F' (typically the bottom panel 16 of the outer sleeve 110) to raise the front end of the lockable receptacle formed from blank 431, including, in particular, the tab formed from tab panels 469 and 471. This is illustrated in FIG. 20C. Again the raising arrangement assists with the correction insertion of the registration mechanism (the two-ply pushing tab) 469/471 into the slot of a housing module 201, 601 for mating with a detector 215 without crashing into the housing module 201, 601.

Figure 21:
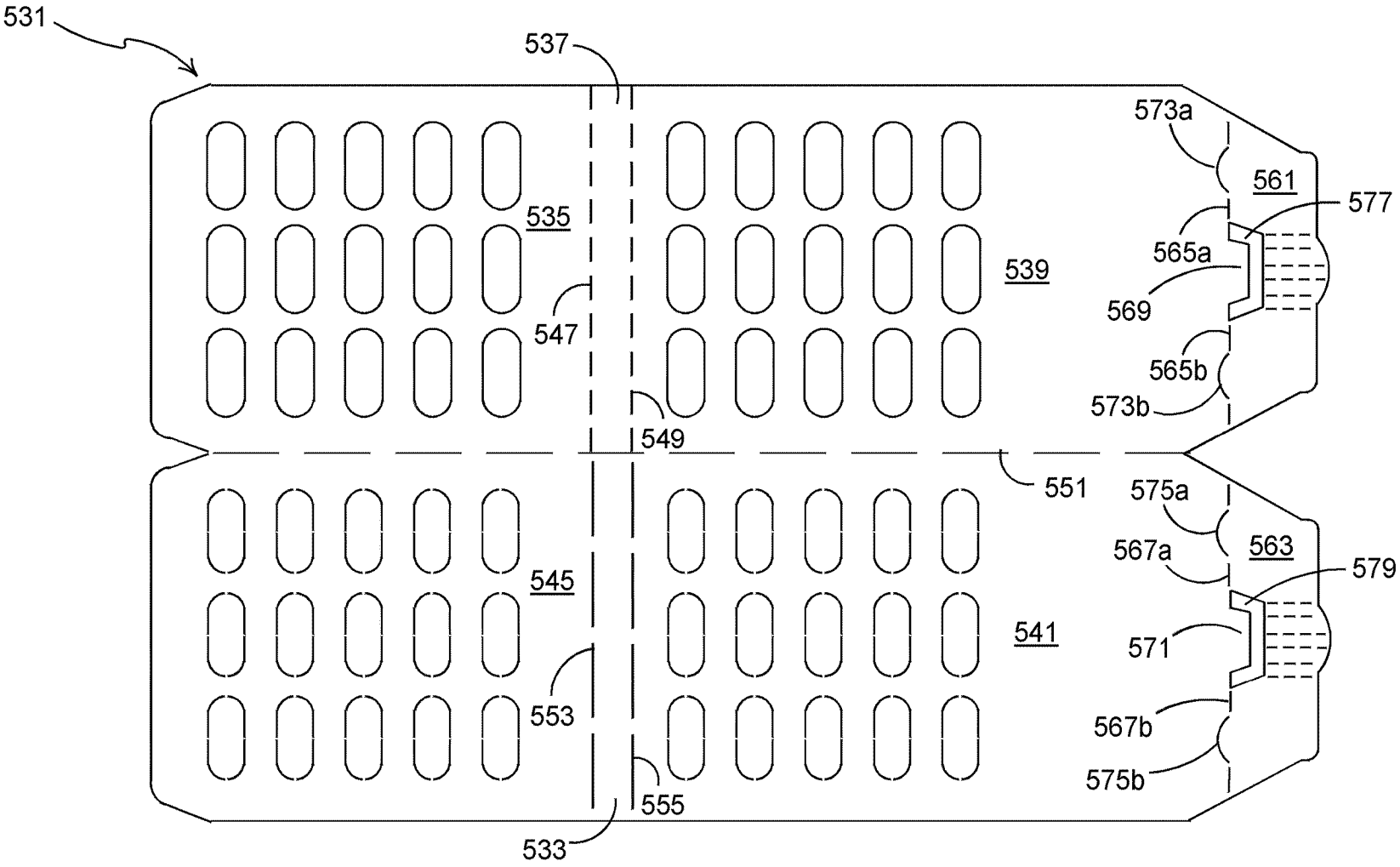
FIG. 21 is a plan view from above of a blank for forming a lockable receptacle according to a further aspect of the disclosure.

In FIG. 21, yet a further embodiment of raising arrangement is shown which comprises rounded raising feet 573*a*/575*a*, 573*b*/575*b* that are again provided proximate to the hinge connection 565*a*/565*b*/567*a*/567*b* as interruptions thereof. In a similar manner to the embodiment of FIG. 20, a cut line 573*a*, 573*b*, 575*a*, 575*b* is used to define a projection that can stand proud of the hinge connection 565*a*/565*b*/567*a*/567*b* to raise the tab 469/471.

Referring now to FIGS. 22A to 22D, there is shown an alternative illustrated embodiment of housing module 601. In this embodiment, like numerals have, where possible, been used to denote like parts, albeit with the addition of the prefix "600" to indicate that these features belong to the alternative embodiment.

The lifting teeth 613*a*, 613*b* have chamfered outer corners (the corners closest to the sled first and second side walls 609*a*, 609*b*). The upper surface of the lifting teeth is rounded or ramped in a direction from an inner tip of each lifting tooth, toward the sled front wall 619. This in-conjunction with or in isolation of the raising arrangement further assists in guiding a registration mechanism (369/371; 469/471; 569/571) so that the leading end of the registration mechanism (369/371; 469/471; 569/571) is guided by the lifting teeth and does not instead abut against them, which may happen if the lifting teeth had blunt front edges.

Upon reading the foregoing it will be recognized that it is the co-operation of two or more or all of: the registration mechanism, raising arrangement, outer sleeve receiving compartment and housing module with stopping ribs, lifting teeth and/or retention wings that enable a smart package to be formed substantially from paperboard that is able to withstand repeated, accurate use whilst securely housing and retaining an electronic device, that is the focus of the disclosure. It is recognized that the various beneficial features described and illustrated may be used, where suitable, alone or, in conjunction with any one or more of the other features. As such the present disclosure should not be treated as being limited to a smart package comprising all of the beneficial features described. It should also be noted that whereas the internal compartment and housing module features have particular benefit for use with paperboard outer sleeves and/or paperboard lockable receptacles, that the inventive aspects of the disclosure are not so limited and it is envisaged that in other embodiments, the outer sleeve and/or lockable receptacle may be formed, at least in part or entirely from other material for example plastics material.

It can be appreciated that various changes may be made within the scope of the present invention, for example, the size and shape of the panels and apertures may be adjusted to accommodate articles of differing size or shape.

It will be recognized that as used herein, directional references such as "top", "bottom", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. A fold line is typically a scored line, an embossed line, or a debossed line. Any reference to hinged connection or fold line should not be construed as necessarily referring to a single fold line only; indeed it is envisaged that hinged connection can be formed from any one or more of the following, a short slit, a frangible line or a fold line without departing from the scope of the invention.

As used herein, the term "severance line" refers to all manner of lines that facilitate separating portions of the substrate from one another or that indicate optimal separation locations. Severance lines may be frangible or otherwise weakened lines, tear lines, cut lines, or slits.

It should be understood that hinged connection, severance lines and fold lines can each include elements that are formed in the substrate of the blank including perforations, a line of perforations, a line of short slits, a line of half-cuts, a single half-cut, a cut line, an interrupted cut line, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The invention claimed is:

1. A smart package comprising: an outer sleeve, a lockable receptacle, an electronic device for detecting or determining when access has been pained to the lockable receptacle, and a housing module to which the electronic device is affixed, the outer sleeve providing a cavity for the lockable receptacle and having a rear end and an open or openable front end through which the lockable receptacle is insertable and through which the lockable receptacle is withdrawable, the package comprising a two-part locking mechanism for locking the lockable receptacle within the cavity of the outer sleeve, and the package comprising a release mechanism for enabling the two-part locking mechanism to be unlocked such that the lockable receptacle can be at least partially withdrawn from the outer sleeve, the outer sleeve comprising an internal compartment for receiving and retaining the housing module and electronic device, wherein the outer sleeve is formed from a blank of foldable sheet material, the outer sleeve having a substantially tubular structure, comprising a top wall, first and second side walls and a bottom wall defining a cavity therein for the lockable receptacle and wherein the internal compartment is formed as a unitary assembly within the tubular structure, comprising a compartment first side panel, a compartment bottom panel, and a compartment second side panel, hinged one to the next in series and wherein a first slot is provided between the compartment first side panel and the compartment bottom panel.

2. A smart package comprising: an outer sleeve, a lockable receptacle, an electronic device for detecting or determining when access has been pained to the lockable receptacle, and a housing module to which the electronic device is affixed, the outer sleeve providing a cavity for the lockable receptacle and having a rear end and an open or openable front end through which the lockable receptacle is insertable and through which the lockable receptacle is withdrawable, the package comprising a two-part locking mechanism for locking the lockable receptacle within the cavity of the outer sleeve, and the package comprising a release mechanism for enabling the two-part locking mechanism to be unlocked such that the lockable receptacle can be at least partially withdrawn from the outer sleeve, the outer sleeve comprising an internal compartment for receiving and retaining the housing module and electronic device, wherein the electronic device comprises a detector, wherein the lockable receptacle comprises a registration mechanism for use with the detector for registering insertion of the lockable receptacle within the smart package and/or for registering withdrawal of the lockable receptacle out of the smart package, the lockable receptacle further comprising a raising arrangement for lifting at least a leading part of the registration mechanism to aid with the accurate location of the registration mechanism relative to the detector.

3. A smart package comprising: an outer sleeve, a lockable receptacle, an electronic device for detecting or determining when access has been pained to the lockable receptacle, and a housing module to which the electronic device is affixed, the outer sleeve providing a cavity for the lockable receptacle and having a rear end and an open or openable front end through which the lockable receptacle is insertable and through which the lockable receptacle is withdrawable, the package comprising a two-part locking mechanism for locking the lockable receptacle within the cavity of the outer sleeve, and the package comprising a release mechanism for enabling the two-part locking mechanism to be unlocked such that the lockable receptacle can be at least partially withdrawn from the outer sleeve, the outer sleeve comprising an internal compartment for receiving and retaining the housing module and electronic device, the housing module having a main body suitable for having the electronic device affixed thereto, the main body comprising one or more retention wings extending from the main body, the one or more retention wings being sized and configured for co-operation with a slot comprised within the outer sleeve such that the housing module is retainable substantially within the outer sleeve and the one or more retention wings are shaped, sized and configured to co-operate with an end-stop of the slot for locating the housing module within the outer sleeve.

* * * * *